US006015202A

United States Patent [19]

Hiramatsu et al.

[11] Patent Number: 6,015,202

[45] Date of Patent: Jan. 18, 2000

[54] RECORDING APPARATUS

[75] Inventors: Soichi Hiramatsu, Yokohama; Takao Aichi, Tokyo, both of Japan

[73] Assignee: Canon Kabushiki Kaisha, Tokyo, Japan

[21] Appl. No.: 08/110,762

[22] Filed: Aug. 23, 1993

Related U.S. Application Data

[63] Continuation of application No. 07/761,297, Sep. 17, 1991, abandoned.

[30] Foreign Application Priority Data

| | | | |
|---|---|---|---|
| Sep. 21, 1990 | [JP] | Japan | 2-250282 |
| Sep. 21, 1990 | [JP] | Japan | 2-250283 |
| Sep. 21, 1990 | [JP] | Japan | 2-250284 |
| Sep. 21, 1990 | [JP] | Japan | 2-250285 |

[51] Int. Cl.[7] ..... B41J 2/165

[52] U.S. Cl. ..... 347/32

[58] Field of Search ..... 347/32, 37, 104, 347/29, 30; 74/335

[56] References Cited

U.S. PATENT DOCUMENTS

| | | |
|---|---|---|
| 4,313,124 | 1/1982 | Hara . |
| 4,345,262 | 8/1982 | Shirato et al. . |
| 4,459,600 | 7/1984 | Sato et al. . |
| 4,463,359 | 7/1984 | Ayata et al. . |
| 4,558,333 | 12/1985 | Sugitani et al. . |
| 4,663,982 | 5/1987 | Nihira . |
| 4,723,129 | 2/1988 | Endo et al. . |
| 4,740,796 | 4/1988 | Endo et al. . |
| 4,752,786 | 6/1988 | Inoue et al. . |
| 4,838,717 | 6/1989 | Ogura . |
| 4,884,909 | 12/1989 | Watanabe et al. . |
| 4,928,050 | 5/1990 | Torisawa et al. . |
| 4,937,593 | 6/1990 | Prats . |
| 5,059,049 | 10/1991 | Rosenthal . |
| 5,148,203 | 9/1992 | Hirano ..... 347/30 |
| 5,168,291 | 12/1992 | Hiramatsu et al. ..... 347/29 |

FOREIGN PATENT DOCUMENTS

| | | |
|---|---|---|
| 0313046 | 4/1989 | European Pat. Off. . |
| 0385550 | 9/1990 | European Pat. Off. . |
| 0409175 | 1/1991 | European Pat. Off. . |
| 0452585 | 10/1991 | European Pat. Off. . |
| 2398613 | 2/1979 | France . |
| 54-56847 | 5/1979 | Japan . |
| 57-006781 | 1/1982 | Japan . |
| 58-155980 | 9/1983 | Japan . |
| 58-157383 | 9/1983 | Japan . |
| 59-070583 | 4/1984 | Japan . |
| 59-123670 | 7/1984 | Japan . |
| 59-138461 | 8/1984 | Japan . |
| 59-224379 | 12/1984 | Japan . |
| 60-71260 | 4/1985 | Japan . |
| 63-122572 | 5/1988 | Japan . |
| 1082962 | 3/1989 | Japan . |
| 1202462 | 8/1989 | Japan . |
| 2208073 | 8/1990 | Japan . |
| 35181 | 1/1991 | Japan . |
| 2047173 | 11/1980 | United Kingdom . |

*Primary Examiner*—N. Le
*Assistant Examiner*—Judy Nguyen
*Attorney, Agent, or Firm*—Fitzpatrick, Cella, Harper & Scinto

[57] ABSTRACT

In a recording apparatus or more specifically an ink-jet printer, a plurality of gears are disposed in parallel with the direction of movement of a carriage and a slide gear is connected with the carriage outside of the recording space and is made to engage with one of a plurality of the gears corresponding the moving position of the carriage. The control sequences each for causing a gear being shifted from one gear engagement position to the adjacent position, are so combined that the gear can be shifted past the adjacent gear engagement position to a desired gear engagement position and the overlapped operations in each of the gear shift control sequence combinations can be skipped.

26 Claims, 21 Drawing Sheets

RECORDING APPARATUS

This application is a continuation of application Ser. No. 07/761,297 filed Sep. 17, 1991, now abandoned.

BACKGROUND OF THE INVENTION

1. Field of the Invention

The present invention generally relates to a recording apparatus and more particularly to a serial printer type recording apparatus in which a recording head is moved in a predetermined direction along a recording medium.

2. Description of the Related Art

In the conventional serial printers, almost all of them use a step motor as a carriage drive motor for driving a carriage for moving a recording head in order to carry out the recording scanning.

Furthermore, many serial printers use as step motor as a drive motor for transporting a recording medium in the form of a sheet (to be referred as "a recording sheet or paper" hereinafter in this specification) in the direction perpendicular to the scanning direction of a carriage.

There has been proposed and demonstrated a recording apparatus in which only one motor is used to accomplish various operations in order to reduce the number of components of the recording apparatus, thereby reducing the cost and size of the recording apparatus. For instance, the Japanese Patent Laid-Open Application No. 5,181/1991, which corresponds to U.S. Ser. No. 513,932 and European Patent Application No. 90-308,663, filed by the same applicant, discloses that various operations of an ink-jet printer such as the recovery operation, the operation of an auto sheet feeder (to be referred to as an "ASF" hereinafter in this specification) and so on can be carried out by a single paper feed motor whose driving power transmission is switched in response to an operation to be carried out in a manner to be described in detail hereinafter.

The above-described recording apparatus or more specifically the ink-jet printer has a plurality of gears which are disposed in parallel with the direction of movement of a carriage and which are driven by a driving means and a slide gear which is connected with the carriage outside of the recording space and which is made to engage with one of a plurality of the gears corresponding the moving position of the carriage.

When the slide gear is made to mesh with one of a plurality of gears, the recording sheet or paper can be transported while the slide gear is placed into engagement with another gear, one or more operations except the recording sheet or paper feed operation become possible.

In the recording apparatus with the above-described construction, when the slide gear is disengaged from one gear and then is caused to mesh with an adjacent gear, the control including the energization of the driving means in combination with the driving of the carriage is carried out.

However, in such recording apparatus, when the control gear is shifted from one operative position to another operative position, the combination of the controls of the carriage driving and the driving means is required and when the slide gear must be shifted to an operative position beyond immediately adjacent operative position, in the case that controls for shifting the slide gear between two adjacent positions are simply combined, resulting in increased driving power switching time.

SUMMARY OF THE INVENTION

The primary object of the present invention is, therefore, to overcome the above and other problems encountered.

Another object of the present invention is to provide a recording apparatus whose time period necessary for a recording operation is reduced.

Also another object of the present invention to provide a recording apparatus whose reliability is markedly improved.

Another object of the present invention is to simplify a combination of controls when a control gear is shifted from a power transmission gear to another power transmission gear by skipping the power transmission gear or gears therebetween, thereby shortening the gear shift time.

A further object of the present invention is to determine how to carry out an operation to be carried out in a gear shift space prior to the setting of a carriage reference position in the initial stage, thereby shortening the gear shift time in the initial stage.

Yet another object of the present invention is to speed up the gear shift operation and to maintain noise at a suitable level by predetermining the value of the driving force produced by a step motor so that a highly reliable recording apparatus which can accomplish the perfect exchange between various operations can be realized.

A further object of the present invention is to prevent the pitch deviation in the recording sheet feed operation which occurs when another operation is carried out during the printing operation that is a control gear connected with a carriage is once disengaged from a recording sheet feed gear and again caused to engage therewith.

A still additional object of the present invention is to prevent the deviation of a recording sheet from its correct position due to the engagement and disengagement between gears in the initial operation period after a power source is turned; that is, to prevent the deviation of a recording sheet from its correctly set position even when the engagement of a control gear connected with a carriage with a recording sheet feed gear and the disengagement of the former from the latter when the power source is repeatedly turned on and off. P In a first aspect of the present invention, a recording apparatus comprises:

- a recording head reciprocally movable along a recording medium;
- a driving power source;
- a plurality of first transmission members which are driven by a driving force generated by the driving power source;
- a second transmission member which can engage with one of the plurality of first transmission members which corresponds to a position of the recording head; and
- means for skipping an overlapped step or steps in the case of switching of the second transmission member between two transmission members among the plurality of first transmission members which are not adjacent to each other.

Here, the recording head may be constructed as an inkjet recording head which discharges the ink drops and lands them on the surface of the recording medium.

The ink-jet recording head may include an element for generating the thermal energy for causing film boiling of the ink which is used as the energy for discharging the ink drops.

In a second aspect of the present invention, a recording apparatus comprises:

- a recording head reciprocally movable along a recording medium;
- a driving power source;
- a plurality of first transmission members which are driven by a driving force generated by the driving power source;

a second transmission member which can engage with one of the plurality of first transmission members which corresponds to a position of the recording head;

means for controlling switching of the second transmission member between two adjacent transmission members among the plurality of first transmission members in accordance with one of a plurality of predetermined sequences, each has a plurality of steps; and means for controlling switching of the second transmission member between two transmission members among the plurality of first transmission members which are not adjacent to each other in accordance with a combination of a plurality of predetermined sequences, of which an overlapped step or steps are skipped.

Here, the overlapped step or steps may be procedures for releasing engagements of the second transmission member with one or more of the first transmission members situated between the two first transmission members which are not adjacent each other.

The recording head may be constructed as an ink-jet recording head which discharges the ink drops and lands them on the surface of the recording medium.

The plurality of first transmission members may have a first driving force transmission gear for feeding the recording medium when the recording operation is carried out, a second driving force transmission gear for supplying the recording medium into the recording apparatus and a third driving force transmission gear for driving a recovery device in order to ensure the satisfactory discharge of the ink drops from the recording head; the first, second and third driving force transmission gears being arranged in parallel with the direction in which the recording head is shifted in the space outside of the space in which the recording head records data on the recording medium; and the second transmission member has a gear which is made to engage with a carriage upon which is mounted the recording head and which is slidable in unison with the carriage in the recording space.

The ink-jet recording head may include an element for generating the thermal energy for causing film boiling of the ink which is used as the energy for discharging the ink drops.

In a third aspect of the present invention, a recording apparatus comprises:

a recording head which is reciprocally movable along a recording medium;

a sensor movable in unison with the recording head; and a member to be detected by the sensor, the member being disposed in the reciprocating path of the recording head and whose output is used for a plurality of decisions.

Here, a recording apparatus may further comprise a driving power source for feeding the recording medium and a mechanism for switching the driving force of the driving power source from a transmission path for feeding the recording medium to one of other transmission paths so that one of the operations except the recording medium feeding is carried out; and the member to be detected is used for the purpose of the detection of the reference position of the recording head and for the purpose of detection of action of the mechanism in the initial operation of the recording apparatus.

The recording head may be constructed as an ink-jet recording head which discharges the ink drops and lands them on the surface of the recording medium.

The ink-jet recording head may include an element for generating the thermal energy for causing film boiling of the ink which is used as the energy for discharging the ink drops.

In a fourth aspect of the present invention, a recording apparatus comprises:

a recording head reciprocally movable along a recording medium;

a driving power source;

a plurality of first transmission members which are driven by a driving force generated by the driving power source;

a second transmission member which can engage with one of the plurality of first transmission members which corresponds to a position of the recording head;

means for detecting whether or not the second transmission member reached a predetermined position in the case of a switching operation of the second transmission member from one of the first transmission members to another; and means for causing the repetition of the switching operation when the second transmission member is not located at the predetermined position.

Here, the recording head may be constructed as an inkjet recording head which discharges the ink drops and lands them the surface of the recording medium.

The plurality of first transmission members may have a first driving force transmission gear for feeding the recording medium when the recording operation is carried out, a second recording force transmission gear for supplying the recording medium into the recording apparatus and a third driving force transmission gear for driving a recovery device in order to ensure the satisfactory discharge of the ink drops from the recording head; the first, second and third driving force transmission gears being arranged in parallel with the direction in which the recording head is shifted in the space outside of the space in which the recording head records the data on the recording medium; and the second transmission member has a gear which is made to engage with a carriage upon which is mounted the recording head and which is slideable in unison with the carriage in the recording space.

A shift speed of the carriage may be decreased from its normal speed in the case of the repetitive switching operation.

A driving force generated by a second driving power source for driving the carriage may be increased in the case of the repetitive switching operation.

The ink-jet recording head may include an element for generating the thermal energy for causing film boiling of the ink which is used as the energy for discharging the ink drops.

A recording apparatus may further comprise a recording head position sensor, thereby detecting whether or not the second transmission member is located at the predetermined position.

In a fifth aspect of the present invention, a recording apparatus comprises:

a recording head for recording;

a step motor for moving the recording head along a recording medium, a first sensor for detecting an angular position of the step motor, a second sensor for detecting a position of the recording head in response to the output signal from the first sensor;

means for driving the step motor by switching of exciting phase according to predetermined exciting timings; and means for controlling the movement of the recording head by using a driving force of the step motor driven by the driving means and a position of the recording head detected by the second sensor.

Here, the recording head may be constructed as an inkjet recording head which discharges the ink drops and lands them on the surface of the recording medium.

The ink-jet recording head may include an element for generating the thermal energy for causing film boiling of the ink which is used as the energy for discharging the ink drops.

In a sixth aspect of the present invention, a recording apparatus comprises:

a recording head reciprocally movable along a recording medium;

a driving power source;

a plurality of first transmission members which are driven by a driving force generated by the driving power source;

a second transmission member which can engage with one of the plurality of first transmission members which corresponds to a position of the recording head; and means for adjusting an engaging condition of the second transmission member when the second transmission member is released from its engagement with one of the plurality of first transmission members and then returns to its engagement with the one of the plurality of first transmission members, so that the second transmission member is engaged with the one of the plurality of first transmission members in the same engaging condition as that before the second transmission member is released from the one of the plurality of first transmission members.

Here, the driving power source is a step motor and the first and second transmission members comprise gears and the means includes a control means for adjusting the number of advanced steps of the step motor from the release to the return to coincide with an even multiple of the number of steps corresponding to one tooth of the gear.

The number of advanced steps may be determined as a common multiple of the number of steps between the number of steps corresponding to one tooth of the gear and the number of phases of one rotation of the motor.

The recording head may be constructed as an ink-jet recording head which discharges the ink drops and lands them on the surface of the recording medium.

The plurality of first transmission members may have a first driving force transmission gear for feeding the recording medium when the recording operation is carried out, a second driving force transmission gear for supplying the recording medium into the recording apparatus and a third driving force transmission gear for driving a recovery device in order to ensure the satisfactory discharge of the ink drops from the recording head; the first, second and third driving force transmission gears being arranged in parallel with the direction in which the recording head is shifted in the space outside of the space in which the recording head records data on the recording medium; and the second transmission member has a gear which is made to engage with a carriage upon which is mounted the recording head and which is slidable in unison with the carriage in the recording space.

The ink-jet recording head may include an element for generating the thermal energy for causing film boiling of the ink which is used as the energy for discharging the ink drops.

In a seventh aspect of the present invention, a recording apparatus comprises:

a recording head reciprocally movable along a recording medium;

a driving power source;

a plurality of first transmission members which are driven by a driving force generated by the driving power source;

a second transmission member which can engage with one of the plurality of first transmission members which corresponds to a position of the recording head;

means for controlling switching of the second transmission member between two adjacent transmission members among the plurality of first transmission members in accordance with one of a plurality of predetermined sequences, each has a plurality of steps;

means for controlling switching of the second transmission member between two transmission members among the plurality of first transmission members which are not adjacent to each other in accordance with a combination of a plurality of predetermined sequences, of which an overlapped step or steps are skipped;

means for detecting whether the second transmission member has reached or not a predetermined position in the case of the switching operation of the second transmission member from one of the first transmission members to another;

means for causing the repetition of the switching operation when the second transmission member is not located at the predetermined position;

a step motor for moving the recording head along a recording medium, a first sensor for detecting an angular position of the step motor, a second sensor for detecting a position of the recording head in response to the output signal from the first sensor;

means for driving the step motor by switching of exciting phase according to predetermined exciting timings;

means for controlling the movement of the recording head by using a driving force of the step motor driven by the driving means and a position of the recording head detected by the second sensor;

means for adjusting an engaging condition of the second transmission member when the second transmission member is released from its engagement with one of the plurality of first transmission members and then returns to its engagement with the one of the plurality of first transmission members, so that the second transmission member is engaged with the one of the plurality of first transmission members in the same engaging condition as that before the second transmission member is released from the one of the plurality of first transmission members;

a third sensor movable in unison with the recording head; and a member to be detected by the third sensor, the member being disposed in the reciprocating path of the recording head and whose output is used for plurality of decisions.

Here, the recording head may be constructed as an inkjet recording head which discharges the ink drops and lands them on the surface of the recording medium.

The ink-jet recording head includes an element for generating the thermal energy for causing film boiling of the ink which is used as the energy for discharging the ink drops.

The above and other objects, effects, features and advantages of the present invention will become more apparent from the following description of embodiments thereof taken in conjunction with the accompanying drawings.

BRIEF DESCRIPTION OF THE DRAWINGS

FIG. 19 is a view used to explain how the initial operation changes depending upon the position of the carriage before the power source is turned on;

DESCRIPTION OF A PREFERRED EMBODIMENT

Now the present invention will become more apparent from the following description of a preferred embodiment thereof taken in conjunction with the accompanying drawings.

(Construction of Whole Recording Apparatus)

Figure 1:
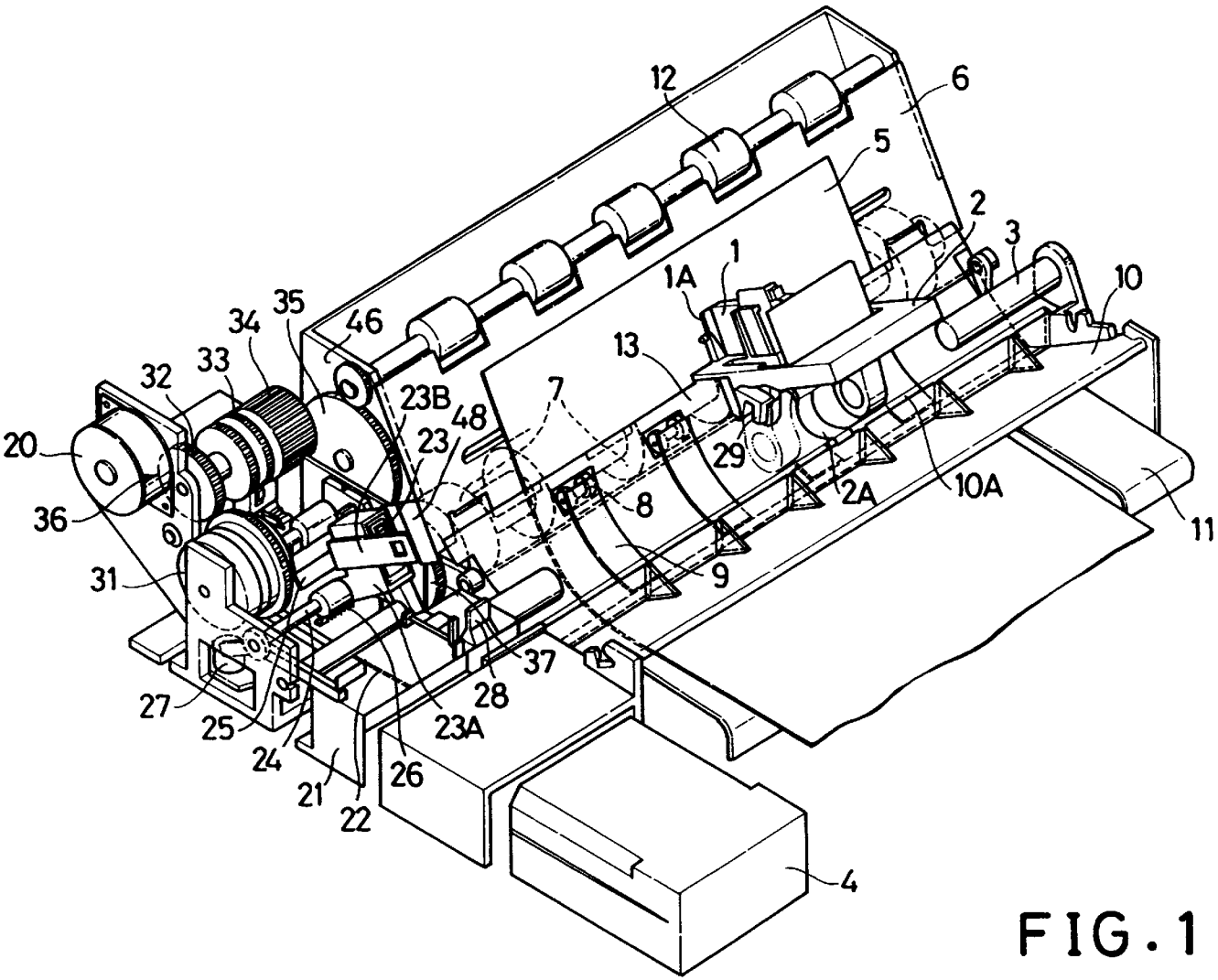
FIG. 1 is a perspective view illustrating the construction of an ink-jet recording apparatus to which is applied the present invention.

FIG. 1 illustrates an ink-jet recording apparatus as a preferred embodiment of the present invention. A carriage 2 upon which is mounted a recording head 1 is reciprocated along a guide shaft by a timing belt extended between an idle pulley and a driving pulley (not shown) when a carriage motor (which is not shown in FIG. 1, but will be described in detail hereinafter with reference to FIGS. 7A and 7B) is energized to rotate in the clockwise or counter-clockwise direction. An ink cartridge 4 supplies ink through an ink supply tube (not shown) to the recording head 1, which in turn discharges the ink drops toward a recording sheet or paper 5 from the discharge portion of the recording head 1 while the carriage 2 is moving from the left to the right, thereby printing the data on the surface of the recording sheet 5. An ink-discharging means as disclosed in, for example, U.S. Pat. No. 4,723,129 may be used. According to this means, the thermal energy causes the rapid changes of the states of a liquid including the quick formation of a bubble in a liquid and the fast shrinkage thereof and in response to the formation of a bubble, the liquid is ejected in the form of a drop. It is preferable that the ink-jet ejection means includes an electric-energy-to-thermal-energy converter. A stationary platen 6 in the form of a plate is disposed in such a way that the recording sheet 5 placed thereon is in opposing relationship with the face of the discharge portion of the recording head 1 and is spaced apart therefrom by a predetermined distance. A recording sheet or paper 5 is fed over the platen 6 by feed rollers 7 in such a way that the recording sheet 5 is clamped between the feed rollers 7 and pinch rollers 8 pressed against the corresponding feed rollers 7 and rotated in unison therewith. Each pinch roller holder 9 is made of stainless steel and imparts the biasing force to its corresponding pinch roller 8 so that the latter is pressed against its corresponding feed roller 7. An upper guide 10 and a lower guide 11 hold the recording sheet 5 inserted by hands so as to transport the recording sheet 6 into the gap between the feed rollers 7 and the pinch rollers 8.

A guide rail 10A is mounted on the upper surface of the upper guide 10 and a leaf spring 2A securely attached to the lower surface of the carriage 2 is slidably engaged with the guide rail 10A. Therefore the carriage 2 itself is biased toward the platen 6 under the force of the leaf spring 2A and part of the carriage 2 is slidably pressed against a sheet pressure plate 13 disposed in front of the platen 6 so that a predetermined distance between the discharge portion of the recording head 1 and the recording sheet 5 is maintained. A portion of the sheet pressure plate 13 in contact with part of the carriage 2 is adjacent to the rear surface of the portion at which the feed rollers 7 are made in contact with the sheet pressure plate 13 so that when the sheet pressure plate 13 is retracted in response to the passage of the recording sheet 5, the carriage 2 is also retracted. Therefore, regardless of the thickness of the recording sheets, the above-described predetermined distance can be maintained so that the production of high-quality recording images is ensured.

Since the recording sheet 5 which is fed by the feed rollers 7 and the pinch rollers 8 is held by the platen 6 which is inclined backwardly by about 30 degrees, an operator can easily recognize the effect of the data printing. The printed recording sheet 5 is clamped between discharge rollers 12 and spurs 12B as shown in FIG. 2 and is discharged into a stacker unit 14.

Figure 2:
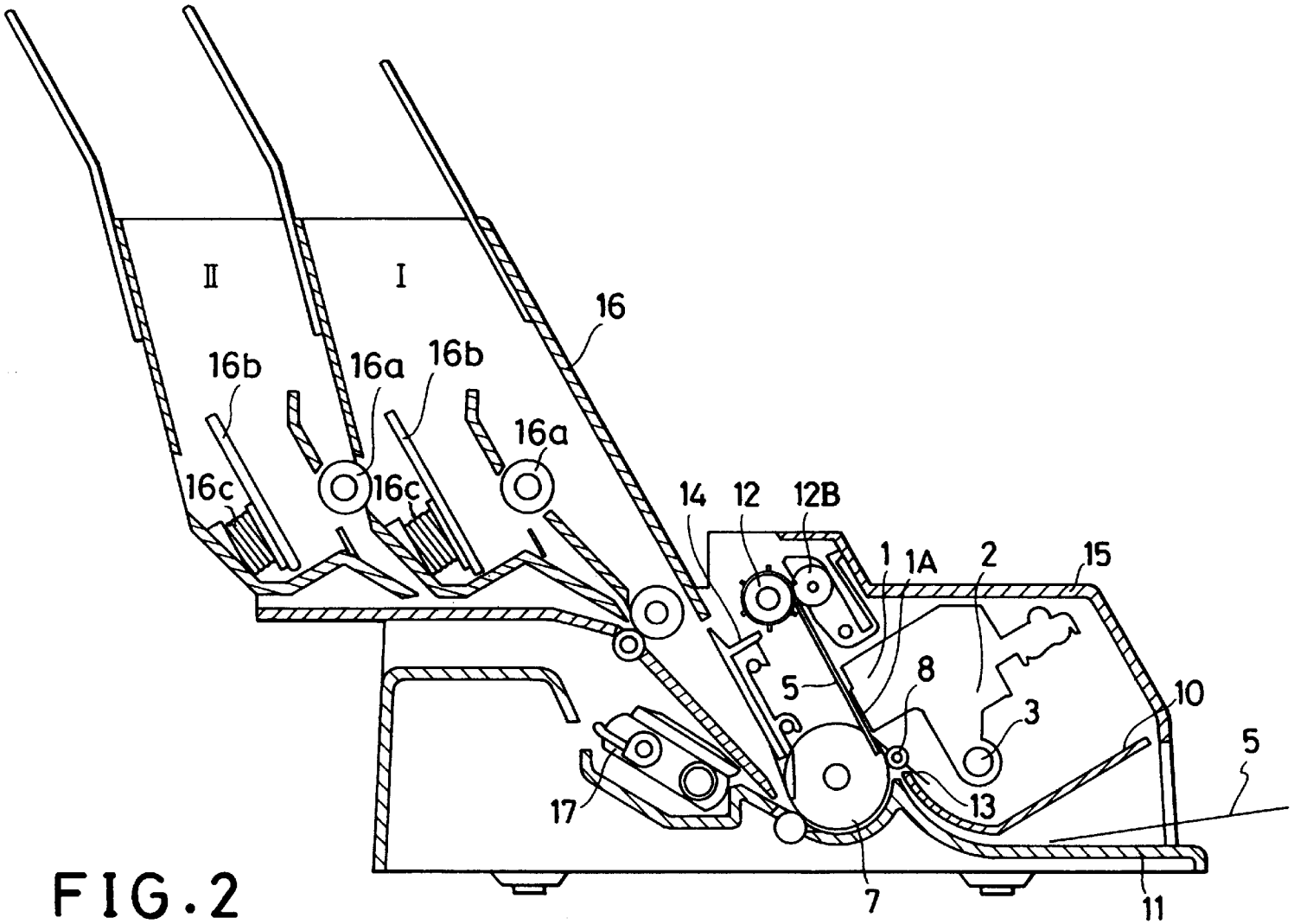
FIG. 2 is a sectional view thereof when it is equipped with ASF.

FIG. 2 illustrates the ink-jet printer equipped with an outer cover 15 and an ASF (Automatic Sheet Feeder) 16 so that the recording sheet can be fed into the printer not only by hands from the front side but also by ASF 16 on the rear side. Furthermore, when a pin feed tractor 17 is provided, a continuous recording sheet or web such as a fanfold paper may be used for recording or printing. In addition, it is possible to dispose a heater (not shown) over the rear surface of the platen 6 so that an ink which takes a long drying time may be used.

The ASF 16 consists of two bins I and II. In each bin, a transport roller 16*a* automatically transports recording sheets (not shown) mounted on a plate 16*b*, to the body of the recording apparatus, one by one. A spring 16*c* presses an uppermost recording sheet on the sheet mounting plate onto the transport roller. A supply roller 18 provided on the recording apparatus transports the uppermost recording sheet supplied from the transport roller 16*a* to a feed roller 7. A pinch roller 18*a* is pressed onto the supply roller 18, and is driven by the supply roller 18.

Next an ink supply device, a recovery device and a recording sheet feed device in accordance with the present invention which are incorporated in the preferred embodiment will be described. All of such devices are disposed only on the left side of the recording space shown in FIG. 1 so that the driving power transmission mechanisms can be simplified in construction, the recording apparatus can be made compact in size and the driving means can be used in common. In this embodiment, the driving means is a feed motor 20 which, as will be described in more detail hereinafter, can drive not only the feed rollers 7 and the discharge rollers 12 but also ASF 16. In addition, it can drive the recovery device so as to accomplish one recovery cycle.

When an ink cartridge 4 is inserted through an insertion opening 21 into the recording apparatus, a hollow needle 22 pierces through the front wall of the ink cartridge 4 so that the ink is supplied through an ink supply tube and an instrument for measuring the quantity still remaining in the cartridge 4 (not shown) to the recording head 1. The recovery device comprises a cap 23, a cap carrier 23A upon which is mounted the cap 23, a cap guide shaft 24 for movably carrying the cap carrier 23A, a guide rail 25 for guiding the cap 23 toward the face 1A of the discharging portion of the recording head 1, a spring 26 for biasing the cap 23 to its initial position on the right side in FIG. 1 and an ink suction pump 27.

The cap carrier 23A has an arm 23B extended toward the passage of the carriage 2 and when the carriage 2 is moved to the left from the position shown in FIG. 1 to its initial position, part of the carriage 2 engages with the arm 23*b* above the carriage 2 so that the carriage 2 is moved further to the left in unison with the cap 23. When the carriage 2 is moved to its initial position, a transparent type sensor (a home position sensor) 29 detects a stationary shutter 28 for detecting the reference position so that the initial position is detected. Thereafter, while the carriage 2 is moving, the face 1A of discharging portion of the recording head is capped by the cap 23.

In the case of the recovery mode after the capping operation, the pump 27 which is communicated through a tube (not shown) with the cap 23 is energized so that the pressure in the cap 23 becomes negative, whereby the ink in the discharge opening of the recording head 1 is sucked. Such recovery operation is carried out by the feed motor 20 by driving force switching means to be described hereinafter. The pump 27 is driven by a pump cam 31. An ASF output gear 33 and a sheet feed output gear 32. An idler gear 35 is in mesh with the sheet feed output gear 34 so as to rotate the feed rollers 17 through a feed gear 37 (See FIG. 4).

A stationary wiper (blade) 48 is disposed perpendicular to the direction of the movement of the carriage 2 so as to engage with the face 1A of discharging portion of the recording head 1 to clean the same.

(Switching Mechanism)

Figure 3:
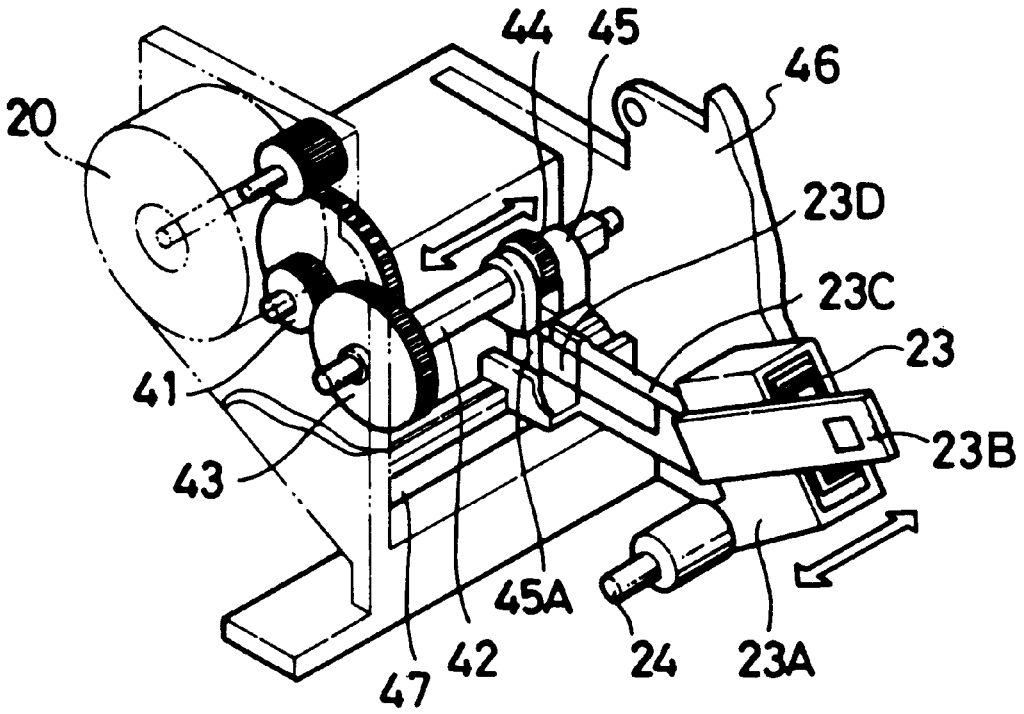
FIGS. 3 and 4 are perspective views to explain the construction of a preferred embodiment of a driving gear shift mechanism in accordance with the present invention.
Figure 4:
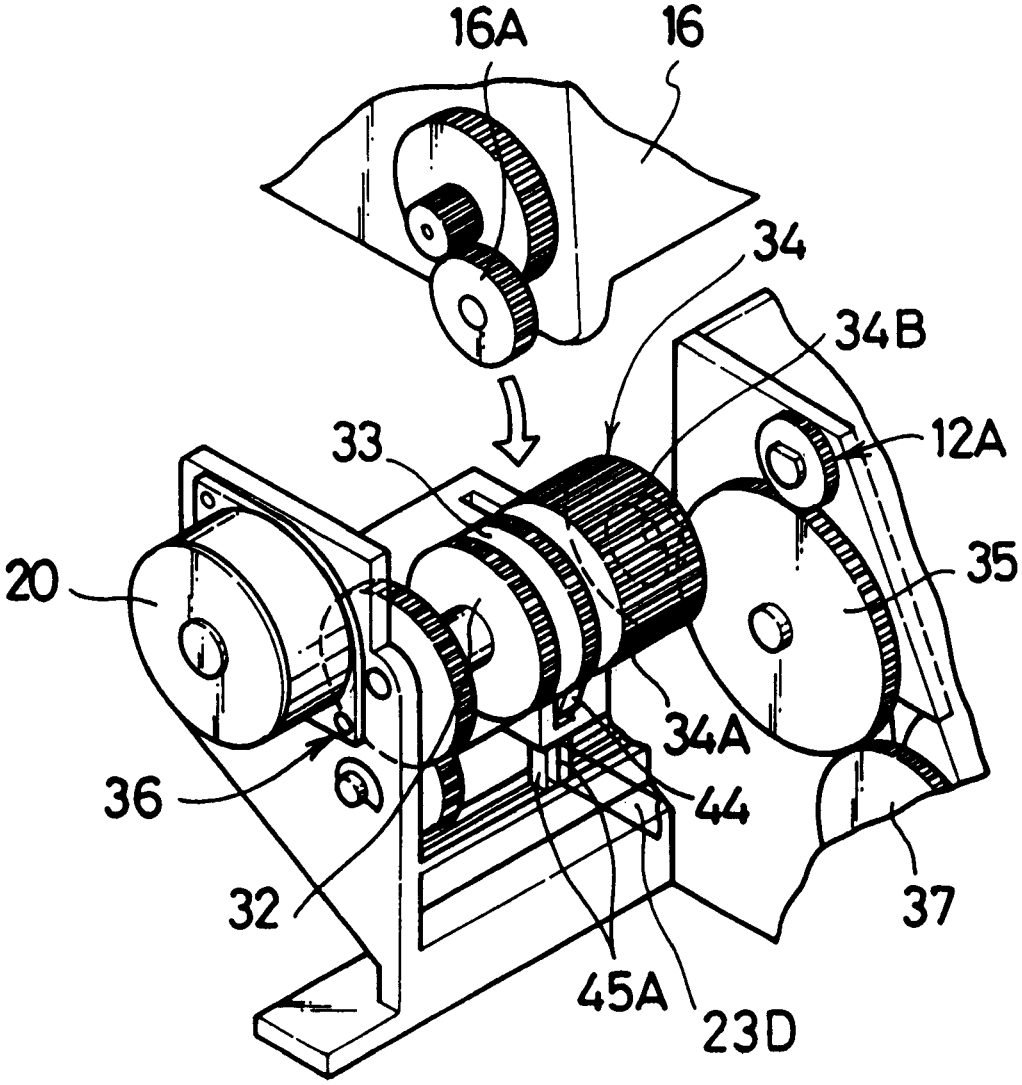

Referring next to FIGS. 3 and 4, an operation switching mechanism actuated by the feed motor 20 will be described. In this embodiment, the power transmission members are described as gears, but other power transmission mechanisms may be used.

First referring to FIG. 3, the rotation of the feed motor 20 is transmitted through an idler 41 to a driving gear 43 carried by a slide gear shaft 42, which has a D-shaped cross sectional configuration and carries through a slide gear holder 45 a slide gear 44 which rotates in unison with the shaft 42. More specifically, as shown in FIG. 4, the slider gear holder has a bifurcated leg portion 45A which in turn is made into engagement with a grooved member 47 supported in parallel with the gear shaft 42 by a frame 46. Therefore, while the bifurcated leg portion 45A moves along the grooved member 47, the slide gear 44 moves in unison with the slide holder 45. A second arm 23C is extended from the cap carrier 23A toward the direction of the grooved member 47 and has a leaf spring 23D extended from the leading end of the second arm 23C and clamped between the two legs of the bifurcated portion 45A of the slide holder 45.

When the cap 23 is made into engagement with the carriage 2 and then caused to move to the left, the slide holder 45 is displaced through the leaf spring 23D in the same direction so that the slide gear 44 is always maintained in opposing relationship with the cap 23. As best shown in FIG. 4, a gear unit 36 which is supported by the frame 46 and has gears which are engageable with the slide gear 44 is disposed above the slide gear 44.

Of the gear unit 36, disposed at the rightmost end is the recording sheet feed output gear assembly 34 consisting of a large gear 34A and a small gear 34B. The large gear 34A is in mesh with the slide gear 44 while the small gear 34B is engaged through an idler 35 with a discharge roller gear 12A. It should be noted here that while the recording sheet feed output gear 34 is in mesh with the slide gear 44, the feed rollers 7 and the discharge rollers 12 can be rotated in the clockwise direction or the counterclockwise direction by the feed motor 20 through the feed gears 37 and the discharge roller gear 12A.

Referring still to FIG. 4, the ASF output gear 33 is coaxial with the large gear 34A and has the same number of teeth and module with the gear 34A. The gear 34 engages with the slide gear 44 when the latter moves and also with an input gear 16A of the ASF 16. Therefore, when the slide gear 44 is in mesh with the ASF output gear 33, the input gear 16A can be rotated in the clockwise or counterclockwise direction. For example, when the gear 16A is rotated in the clockwise direction, the ASF 16 feeds a recording sheet and when it is rotated in the counterclockwise direction, the high-grade functions such as the selection of first bin I or second bin II of ASF 16 can be carried out.

Figure 5A:
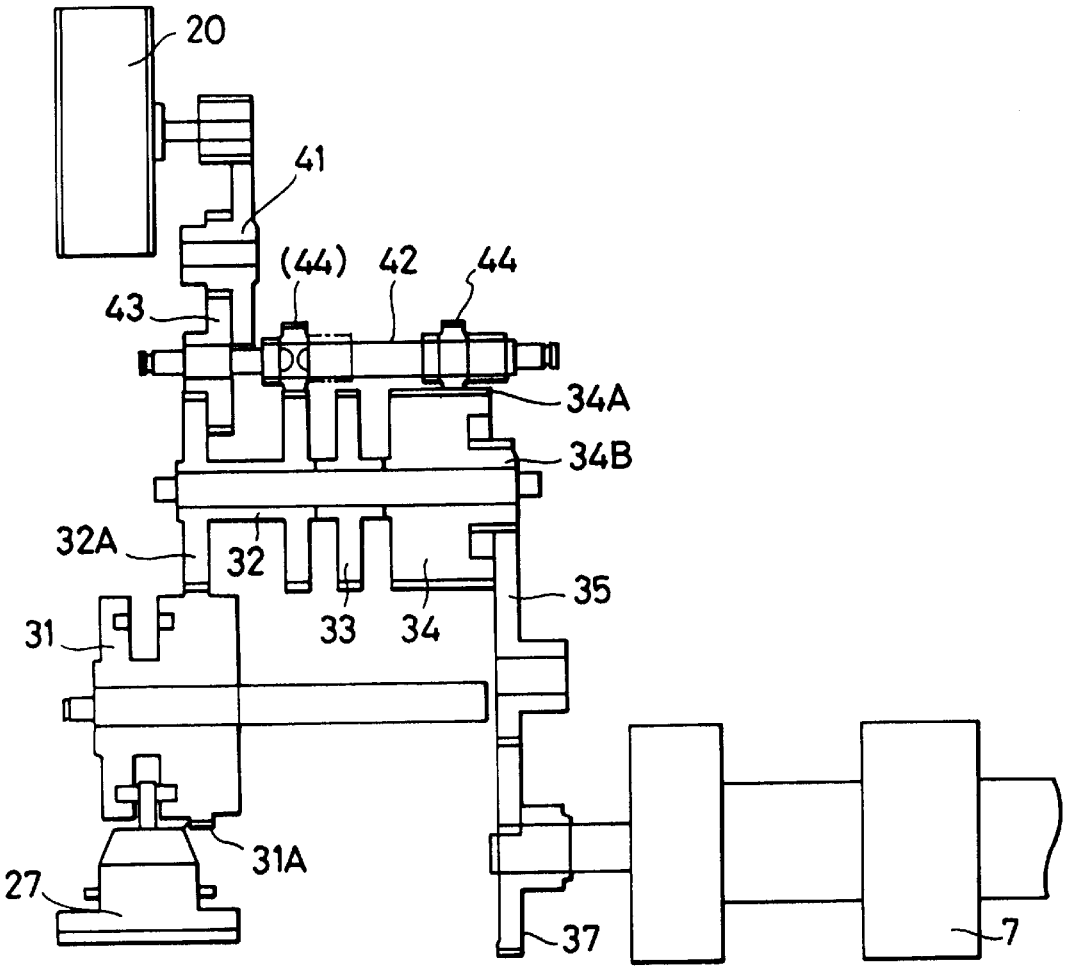
FIG. 5A illustrates the arrangement of the driving gear shift mechanism show in FIGS. 3 and 4.
Figure 5B:
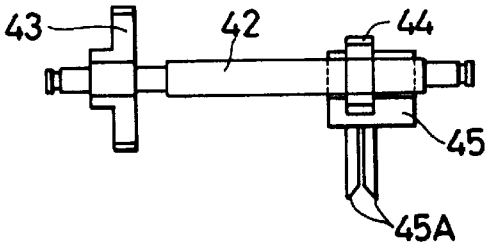
FIG. 5B is a view to explain a slide gear shaft shown in FIG. 5A.

The pump output gear 32 at the left end of the gear unit 36 in FIG. 4 is in mesh with the slide gear 44 when the latter is moved to its leftmost position as shown in two-dot-chain lines in FIG. 5A while another pump output gear 32A is in mesh with the driving gear 31A of the pump cam 31. Therefore, when the slide gear 44 has moved to its leftmost position, the pump cam 31 is driven by the feed motor 20 so that the cam 31 causes the pump 27 to carry out the pumping action. That is, as described above, depending upon the position at which the carriage 2 is stopped, the driving force of the feed motor 20 can be transmitted through the slide gear 44 to one of the recording sheet feed output gear 34, the ASF output gear 33 and the pump output gear 32 so that the recording sheet feed operation, the automatic recording sheet feed operation or the pumping action is carried out.

Next will be described the operation of the slide gear 44 to engage with each of the above-described gears in response to the displacement of the cap carrier 23A caused by the position of the carriage which moves to the left outside of the recording space. In such switching operations of the output gears, the leaf spring 23D interposed between the cap carrier 23A and the slide holder 45 makes the buffer action.

Figures 6A, 6B, 6C:
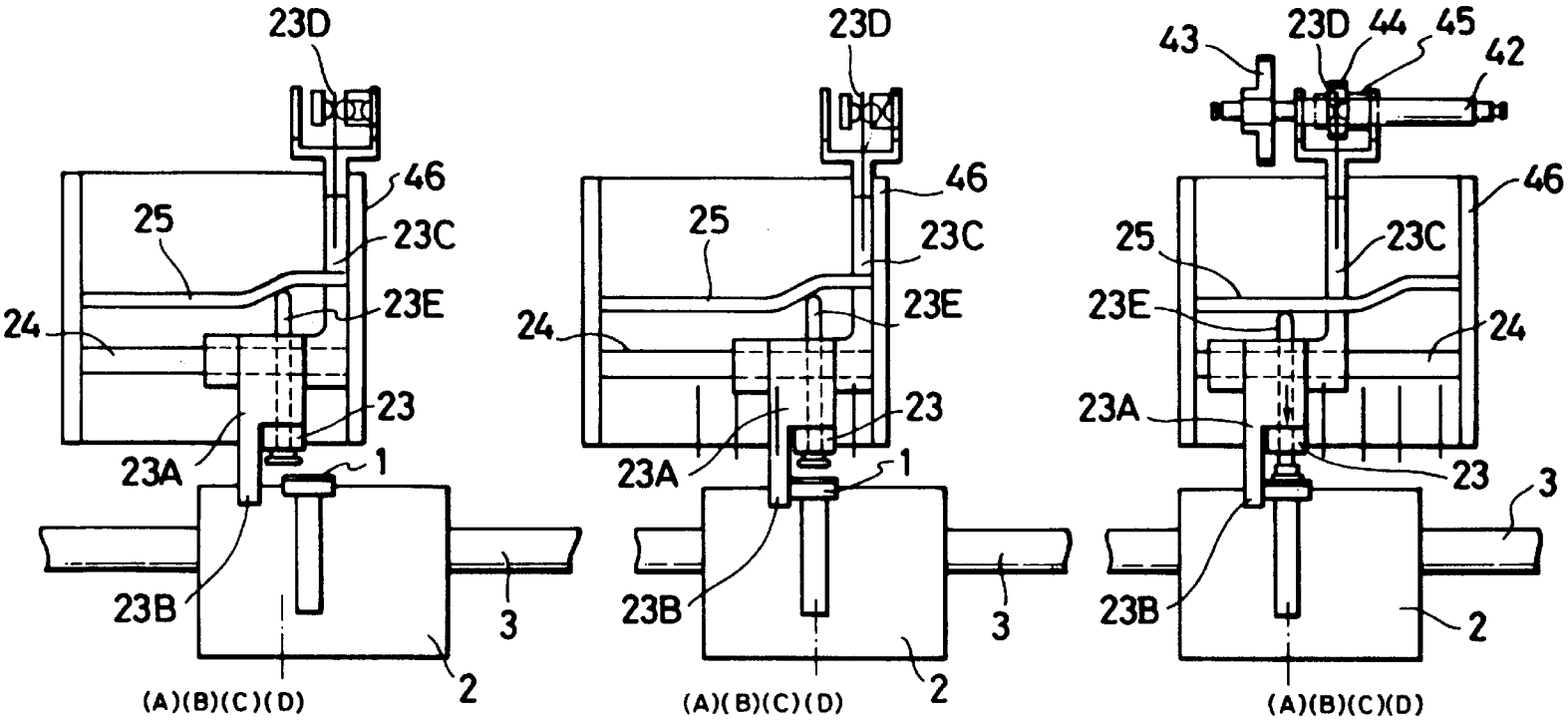
FIGS. 6A–6C are views used to explain the engagement and disengagement relationship between a carriage and a cap carrier in accordance with the present invention.

Now it is assumed that the carriage 2 is moved from the right recording space shown in FIG. 1 toward the position shown in FIG. 6A and then to the position shown in FIG. 6B, the recording head 1 engages with the arm 23B of the cap carrier 23A and thereafter the cap carrier 23A is movable along the guide shaft 24. In FIGS. 6A–6C, (A)–(D) indicate the positions at which the slide holder 45 and the slide gear 44 can be maintained while the cap carrier 23A holds the cap 23. Of these positions, at the positions (A)–(C), for instance, as shown in FIG. 6C, the actuating arm 23E of the cap 23 which is guided by the rail 25 is extended toward the recording head 1 so that the capping state or mode can be maintained. The position (D) is the position at which the slide holder 45 and the slide gear 44 wait for effecting the feed of a recording sheet while the recording operation is being carried out. When the carriage 2 is at the position (D) as shown in FIG. 69, the slide gear 44 (not shown in FIG. 6B) is in mesh with the recording-sheet feed output gear 34 and under this condition a recording sheet is carried out by the motor 20.

At the position (D), the recording head is in opposing relationship with the cap and the preliminary discharge of the ink, which is not associated with the recording at all, is carried out by the electro-thermal converting elements in response to the signals applied thereto. In this embodiment, the preliminary discharge of the ink is carried out at the time when the printing operation is started and during the time when the printing operation continues for one minute.

When the carriage 2 is moved further to the left from the position (D), the slide gear 44 is disengaged from the sheet feed output gear 34 at the position (B) and is made in mesh with the ASF output gear 33. But when the tooth phase difference occurs, the perfect engagement between the ASF output gear 33 and the sheet feed output gear 33 is not ensured, but when the cap carrier 23A is once moved to the position corresponding to the position (B), the difference in displacement between the cap carrier 23A and the slide gear 44 which occurred by interference of the teeth of gears 44 and 33 can be absorbed by the bending of the leaf spring 23D. Thereafter, the feed motor 20 is energized so that, as shown in FIG. 3, the slide gear 44 is driven through the driving gear 43 and the gears 44 and 33 are made into perfect engagement with each other when the tooth phases of the gears 44 and 43 coincide each other, whereby the ASF output gear 33 is driven.

For instance, the teeth of the slide gear 44 and the sheet feed output gear 34 engage tightly with each other immediately after the recording sheet feed operation has been carried out so that the frictional force is produced between the intermeshing teeth. As a result, the disengagement of the gear 44 from the gear 33 cannot be easily accomplished, but even under such condition, the intermeshing between the gears 44 and 33 is temporarily maintained by the bending of the leaf spring 23D and when the feed motor 20 is reversed in rotation, the friction between the teeth can be eliminated.

The position (A) is the position at which the recovery operation such as the pumping action is carried out as shown in FIG. 6C. Under this condition, the slide gear 44 can be made into mesh with the pump output gear 32 and as shown in FIG. 5A the pump 27 is driven by the gear 32A through the pump cam 31. The position (C) is the position at which the recording head 1 which is capped is waiting and it is, of course, possible to feed a recording sheet into the recording apparatus.

(Carriage Driving Motor)

Figure 7A:
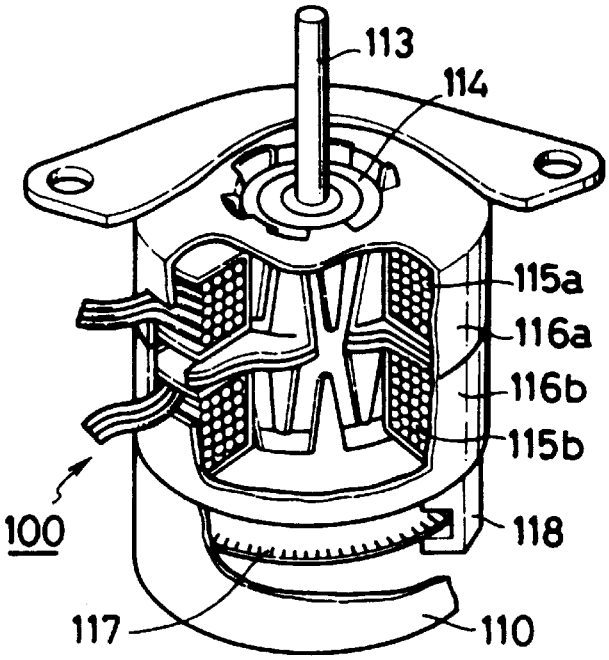
FIG. 7A is a perspective view with a part cut away of a carriage driving motor in accordance with the present invention.
Figure 7B:
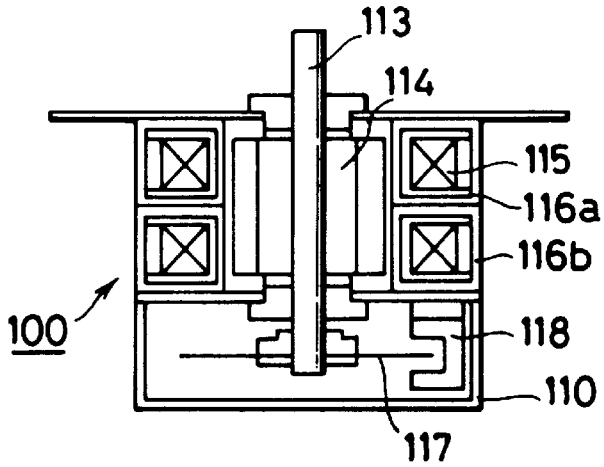
FIG. 7B is a sectional view thereof.

FIGS. 7A and 7B illustrate the interior construction of the carriage motor in accordance with the present invention which is driven under the above-described conditions. Reference numeral 110 represents a casing; 113, a rotor shaft; 114, a rotor; 115*a* and 115*b*, coils; 116*a* and 116*b*, stators; 117, a disk with a slit; and 118, a photointerrupter for detecting the slit. The disk 117 and the photointerrupter 118 constitute an encoder for detecting the angular position of the rotor 114 of the motor 100. The displacement of the carriage 2 is carried out by a timing belt extended by a driving pulley carried by the rotor shaft 113 and an idler pulley.

Figure 8:
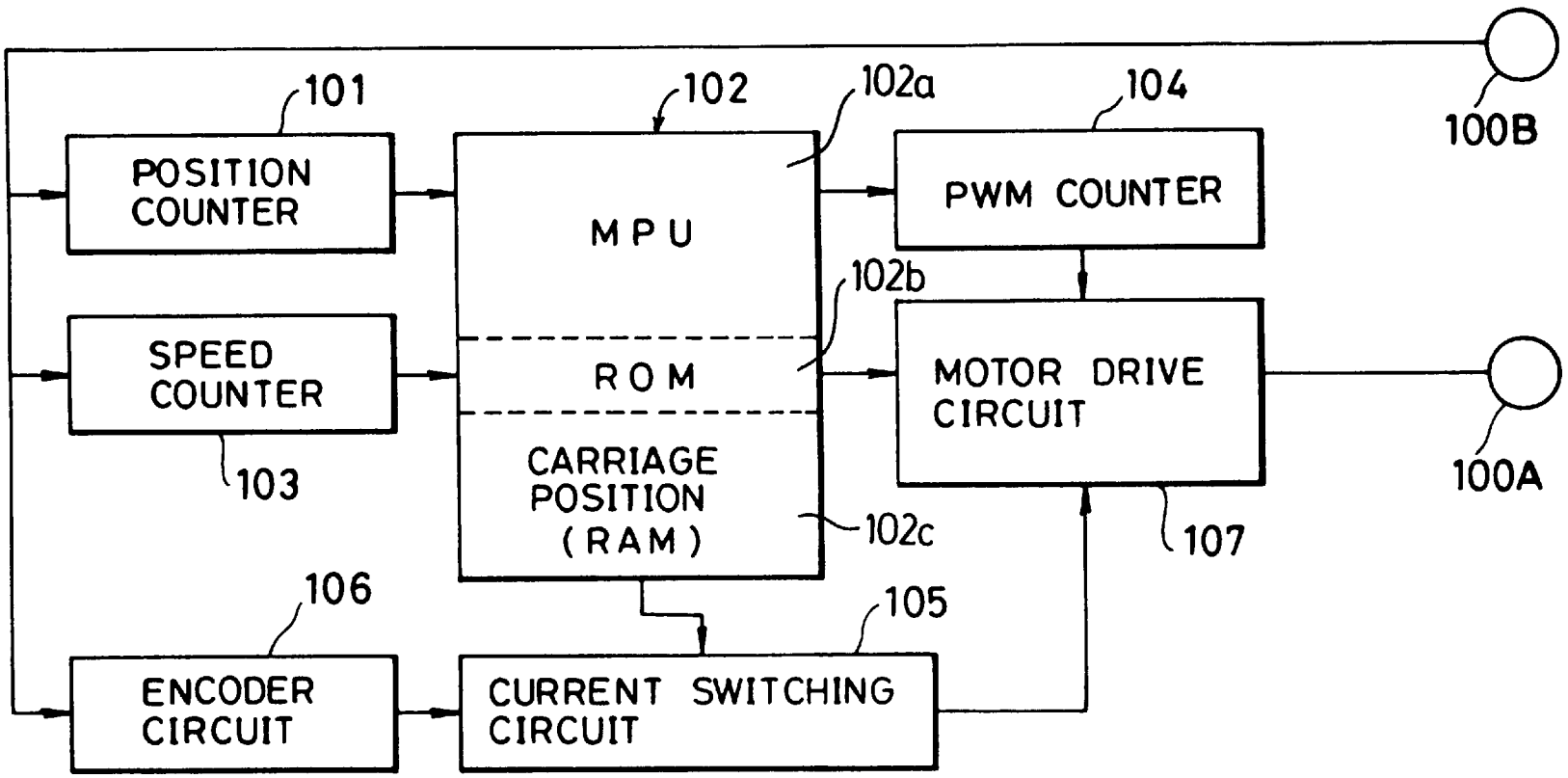
FIG. 8 is a block diagram of a carriage motor in accordance with the present invention.

FIG. 8 is a block diagram illustrating the mode of driving the step motor 100 for driving the carriage 2. In this embodiment, the carriage driving motor 100 consisting of the unitary construction of the encoder and the motor is used so that the step motor unit 100A and the encoder 100B are shown independently of each other in FIG. 8.

A position counter 101 counts the number of signals delivered from the encoder 100B. According to this embodiment MPU 102, comprised of a processor 102*a*, a ROM 102*b* and a RAM 102*c*, detects the position of the carriage 2 in response to the number of signals counted by the position counter 101 so as to control a setting position, the switching of the motor driving systems and so on.

A speed counter 103 utilizes the signals delivered from the encoder 100B so that MPU 102 detects the rotational speed of the step motor 101A or the carriage speed. The speed counter 103 detects a pulse width of the signal delivered from the encoder 100B. MPU 102 receives and processes the output from the speed counter 103 and delivers a required PWM value (which is the duty factor of the pulse-width modulation; when the output is high, the duty is increased so that the large electric current flows) to PWM counter 104, thereby effecting the closed-loop or feedback control of the carriage motor 100.

A current switching circuit 105 controls the switching of the exciting phase of the step motor in response to a predetermined value which is determined by an encoder circuit 106 to which is applied the output signal from the encoder 100B.

A motor drive circuit 107 responds to the PWM value delivered from the PWM counter 104 to drive the step motor 101A at the current switching timing determined by the current switching circuit 105.

Next the mode of the closed-loop or feedback system for driving the carriage motor 100 will be described.

The encoder 100B rotates in synchronization with a rotation of a step motor 100A and generates pulse signals. The current switching circuit 105 sets the switching timing for excitation phases of the step motor 100A by using the pulse signals. The speed counter 103 measures a width of the pulse signal to detect a rotation speed of the step motor 10A. Processing in accordance with a predetermined procedure residing on an inner ROM in MPU 102, is performed by using a detected rotation speed value, and hence a necessary PWM value is calculated and is set to the PWM counter 104. If the rotational speed of the step motor 100A, for example, is faster than the target or specified rotational speed, the PWM value is set to a smaller value so as to make a duty ratio of the PWM signal small. As a result, the rotational speed of the step motor 100A becomes slow.

In response to the PWM value calculated by MPU 102 and the phase switching timing determined by the current switching circuit 105, the step motor 100A is energized through the motor drive circuit 107 and the rotational speed of the step motor 100A is also detected by the encoder 100B. The closed-loop or feedback controlled step motor 100A is driven by the above-described closed-loop or feedback control system.

Next the method for driving the carriage motor 100 as a step motor will be described.

As in the case of the driving of the conventional step motors, the exciting phase switching is carried out not by the current switching circuit 105 but by the exciting timings (time) previously stored in a ROM in MPU 102. The value of the electric current in the case of the exciting phase switching is controlled depending upon the PWM value. More specifically, a PWM value previously determined by MPU 102 is delivered through the PWM counter 104 to the motor drive circuit.

In the above-described manner, the step motor 100A can be driven with the current value (the PWM value) determined at the determined phase switching timing. In this case, the encoder signals are generated and delivered through the position counter 101 to MPU 102 so as to detect the position of the carriage 2. In the case of the driving of the conventional step motor, the position of the carriage is detected by counting the exciting phase switching determined by MPU 102, but in this embodiment, the position of the carriage 2 can be detected not only by the conventional method for counting the number of exciting phase switchings but also by counting the encoder output signals.

Thus, the carriage motor 100 is driven like a step motor in the manner described above.

(Carriage Position and Mode of Driving Motor)

Figure 9:
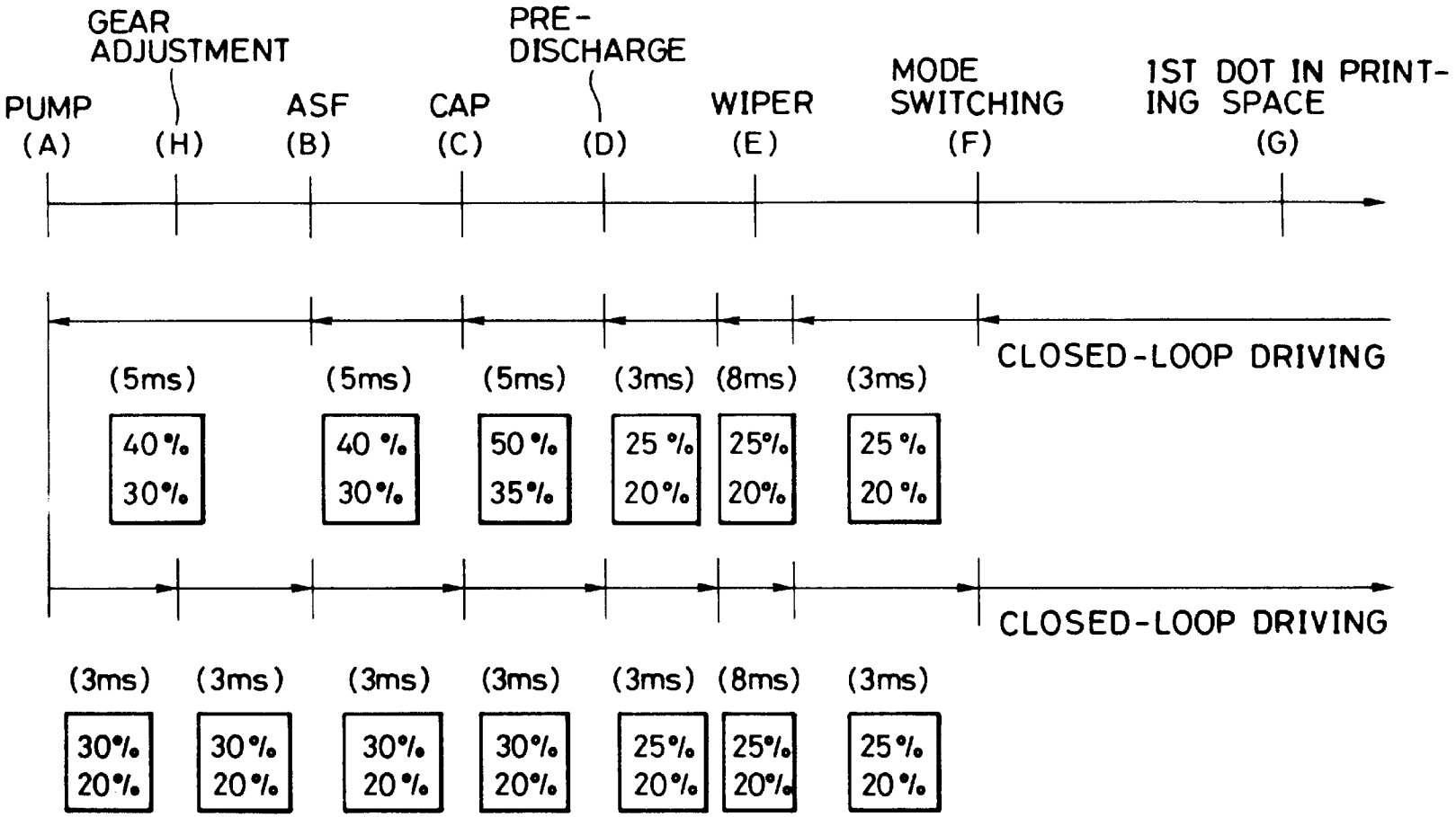
FIG. 9 is a view used to explain the mode of operation thereof.

FIG. 9 illustrates that the operation is carried out depending upon the position of the carriage 2 and how the carriage motor 100 is driven and corresponds to the left end recording position shown in FIG. 1.

The positions (A)–(D) have been described with reference to FIGS. 3–6 in conjunction with the capping and the driving switching. As described above, at the position (A) the driving power is transmitted to the pump 7; at the position (B), the driving power is transmitted to the ASF 16; at the position (C) the driving power is transmitted to the mechanism for feeding a recording sheet into the recording apparatus and the recording head 1 is capped; and at the position (D) while the driving power is transmitted to the recording sheet feed mechanism, the recording head is in opposing relationship with the cap for preliminary ink ejection.

Furthermore, the position (E) is the position at which the wiping operation is carried out by the wiper 48; the position (F) is the position at the right side of which the closed-loop or feedback operation for the printing operation is carried out and at the left side of which the step motor is energized under its driving conditions; the position (G) indicates the first dot in the printing space; and the position (H) is the position at which the slide gear is disengaged from the sheet feed output gear 44, is moved to the pumping position and is then returned to the position (H) to prevent deviation of the sheet feed position.

A time (ms) in which each parenthesis indicates the motor-phase exciting switching time (in milliseconds) described in conjunction with the step motor operation defined the carriage speed. The percentages in each square indicate the duty of the PWM and the higher the percentage, the more the current flows. The upper duty represents the duty value of PWM in the case of the one phase excitation in the 1–2 phase excitation method driving while the lower duty indicates the PWM duty value in the case of the two-phase excitation. That is, according to this embodiment, in the case of driving the step motor, the driving by the 1–2 phase excitation method is carried out and the PWM value is set a different value depending upon the one phase excitation and the two phases excitation. In the case of 1–2 phase excitation method, when the current has the same value in the one phase excitation and the two phases excitation, the PWM value is set at a larger value in the one-phase excitation because the torque in the case of the one phase excitation is less than that in the case of two phases excitation. In addition, in this embodiment, in order to produce the same degree of torque, the PWM value in the case of the two-phase excitation is determined to be about $1/\sqrt{2}$ of the PWM value in the case of the one-phase excitation. As described above, according to this embodiment, the step motor drive is carried out whenever the phase switching is made, and the PWM value is varied according to the phase excitation.

Furthermore, at each position, the carriage speed or the motor phase excitation switching time is switched. For instance, in the case of the wiping operation, the motor is driven at a predetermined rotational speed (8 ms in this embodiment) slower than the normal speed so that the perfect wiping operation is ensured. In addition, in order to shorten the overall operation time, only when the minimum number of operations is required, the speed is set at 8 ms, but in the case of an operation carried out prior to or after each of the operations carried out at 8 ms, the driving speed is increased to 3 ms.

Within the range (A)–(D) of the driving switching mechanism, the displacement to the left is carried out against the force of the spring 26 and since the driving torque is required, the speed is slowed down to 5 ms, but in the case of the movement to the right, the spring 26 springs back so that the high-speed driving at 3 ms is carried out. In the case of the movement from the position (D) to the position (C), the cap 23 rides over the cam-shaped portion of the rail 25 so that the stronger torque is required and consequently the PWM value is increased to 50–30%.

Moreover, various values required for controlling the operation of the recording apparatus can be stored in the form of a table in the ROM within the MPU.

(Control Sequence)

Next referring to FIGS. 10 and 11, the mode of controlling the feed motor and the carriage motor in the driving switching positions (A)–(D) will be described.

In this embodiment, the each movement of the carriage between the two adjacent positions (A), (H); (H), (B); (B), (C) and (C), (D) is made according to a corresponding subroutine. For instance, in the case of the movement from (A) to (D) of the carriage, the combination of the subroutines for displacing the carriage from (A) to (H), from (H) to (B), from (B) to (C) and from (C) to (D) is carried out. Since the fundamental flow is similar in each subroutine, the description of one subroutine will be enough to understand the present invention.

Figure 10:
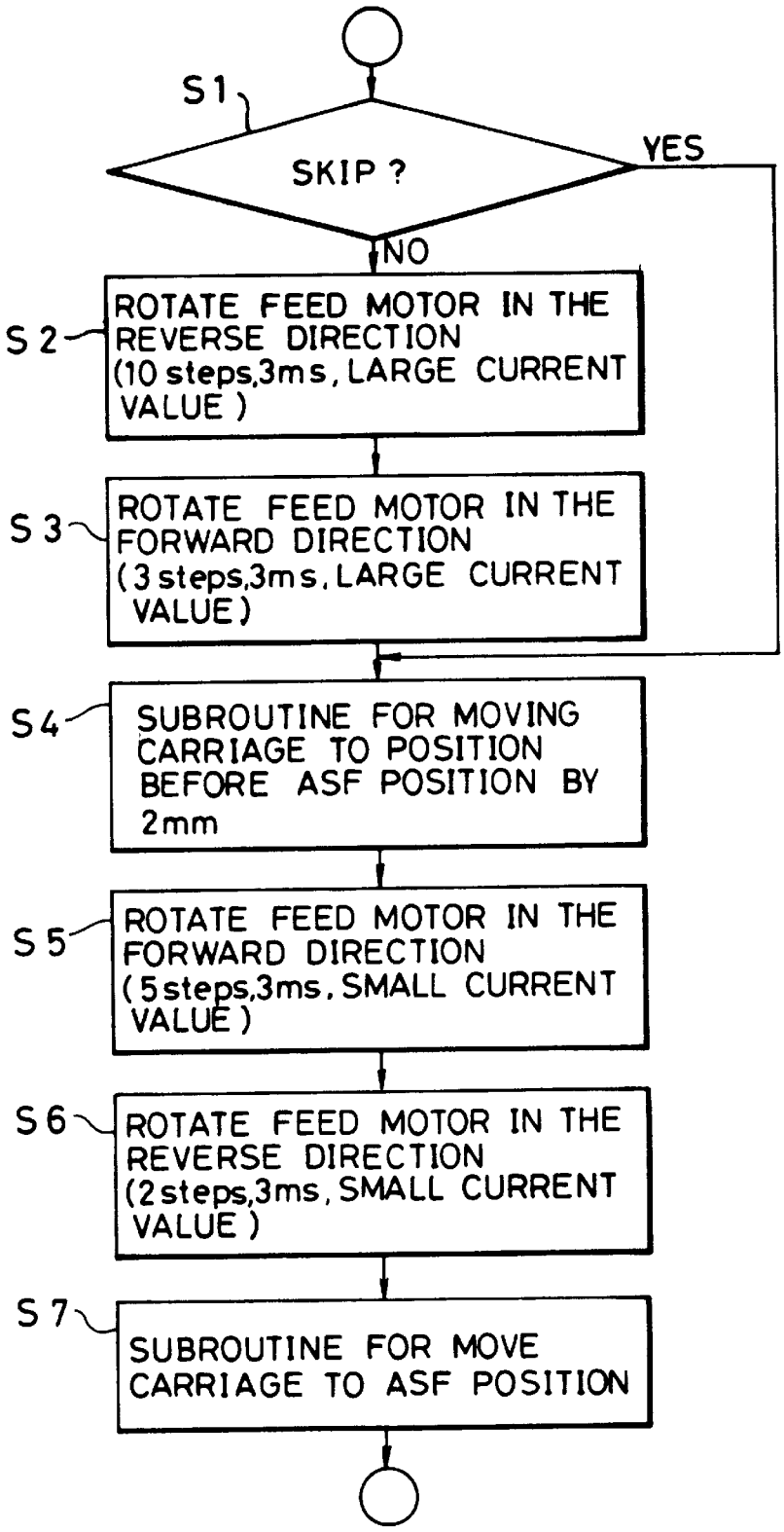
FIGS. 10 and 11 show a flowchart used to explain the driving sequences of a recording sheet feed motor and the carriage motor in the gear shift unit.

FIG. 10 illustrates a subroutine for moving the carriage from the cap position (C) to the ASF position (B).

First, the decision made in step S1 will be described. For instance, it is assumed that immediately before the subroutine is called, the carriage has moved from the preliminary discharge of ink position (D) to the cap position (C). In this case, at the last of the subroutine for the movement of the carriage from (D) to (C), the pressure applied to the slide gear is released. This fact overlaps with the operation of releasing the slide gear carried out in steps 2 and 3 in this routine. Therefore, for the purpose of shortening the time, the steps S2 and S3 are skipped (or bypassed). The decision whether such bypass is established or not can be carried out in response to a flag which is set when the continuous movement of the carriage is carried out. For instance, the flag area may be provided in a RAM in MPU.

In steps S2 and S3, the pressure of the slide gear 44 against the sheet feed output gear 34 is released so that the slide gear 44 becomes movable and consequently the carriage also becomes movable. That is, when the slide gear 44 is rotated by rotating the feed motor 20 in the reverse direction in step S2, the backlash of each gear is eliminated and the gear 44 is pressed against the sheet feed output gear 34 in a satisfactory degree. Under this condition, in step S3, the feed motor 20 is rotated by an angle in response to predetermined pulses (in this embodiment, three pulses) in the direction opposite to the direction in which the step motor is rotated in step S2; that is, in the forward direction so that the engagement between the pressure of the slide gear 44 against the sheet feed output gear 34 is perfectly released. In this case, the current to be supplied to the sheet feed motor 20 can be switched to one of a large, medium or small current value and when the sheet feed motor is operatively connected to the sheet feed output gear 34, the large current is supplied to the motor since a strong voltage torque is required. In this embodiment, the phase switching timing is set at 3 ms.

Figure 11:
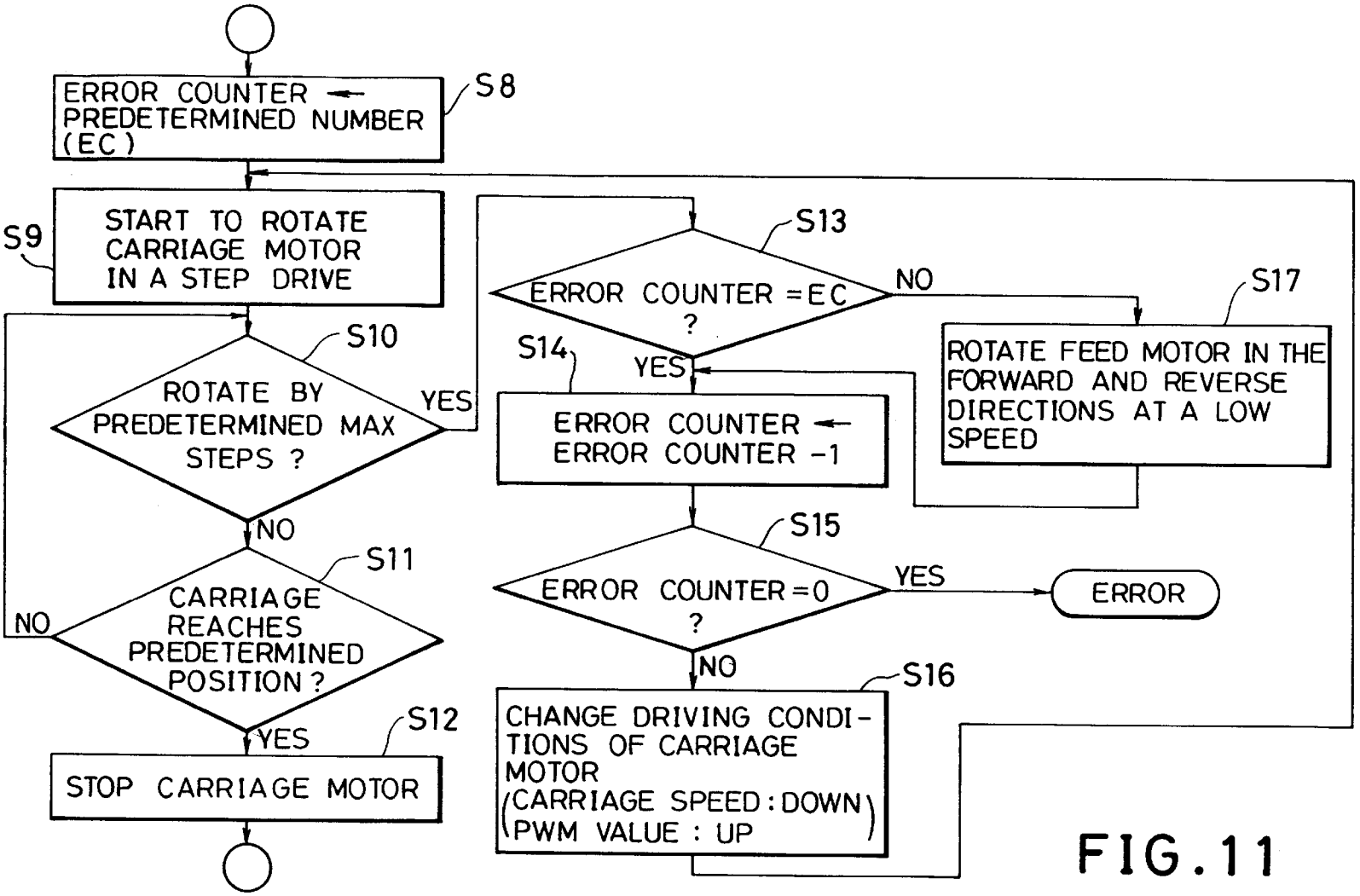

Step S4 is a subroutine, shown in detail in FIG. 11, for moving the carriage to a predetermined position. In this embodiment, the carriage is moved to the position before the ASF position (B) by about 2 mm.

Now referring specially to FIG. 11, this subroutine will be described. First, an error counter in step S8 is used to control the operation of the recovery of the carriage when the latter cannot reach a predetermined position by the normal operation. In this embodiment, as will be described hereinafter, during the first recovery sequence, only the force for moving the carriage is increased and in the recovery sequences following the first stage, the sheet feed motor 20 is also driven. When the carriage fails to reach a predetermined position even after a predetermined number (EC times) of the recovery sequence has been carried out, the error counter is set to "EC" in step S8 in order to control the error decision.

By using the above-described recovery sequence, the condition for carrying out the step rotation of the carriage motor is determined in step S9 in such a way that the driving force with some margin is produced. As a result, the excessive driving force is suppressed and therefore the driving noise is reduced to minimum. In this embodiment, in the case of the movement of the carriage from (C) to (B), the driving of the step motor is so controlled that during the 5 ms switching timing, the PWM duty becomes 40% in the case of the one-phase driving and 30% in the case of the two-phase driving by the 1–2 phase excitation. In this case, by using a position counter 101 shown in FIG. 8, a number of steps of the carriage motor calculated in terms of the distance of the movement which is the difference between the present carriage position counted by MPU 102 and a predetermined position plus a predetermined margin step is set as the maximum step number. In step S11, the position counter 101 which responds to the encoder output signals, detects whether the carriage has reached a predetermined position or not and when the carriage has reached a predetermined position, the carriage motor is deenergized in step S12.

Meanwhile, when the carriage is detected in step S10 to have not yet reached a predetermined position even when the step motor has rotated beyond the maximum number of steps determined in step S9, the recovery sequence is carried out. In step S13, the sheet feed motor which is energized in step S17 is not energized in the first recovery sequence stage. In steps S14 and S15, when the carriage has failed to reach a predetermined position even after the recovery sequences have made a predetermined (EC) times, the erroneous operation is indicated. In step S16 the driving power increased because the carriage has not reached a predetermined position under the driving conditions determined in step S9. For instance, when the conditions (5 ms, 40% and 30%) determined in step S9, the driving conditions are changed to 5 ms, 60% and 40%) to increase the driving force.

In step S17, when the slide gear 44 cannot be disengaged from the gears because of a certain reason or when it fails to engage with these gears, the sheet feed motor 20 is rotated at a slow rotational speed to eliminate such problems.

Referring back again to FIG. 10, the reason why a predetermined position is not the ASF position (B), but is a selected position slightly before the ASF position (B) is as follows. When the carriage is shifted in step S4, the slide gear 44 is normally not in mesh with the ASF output gear 33 and the leaf spring 23D performs the buffer action (See FIGS. 3–6). When the buffer action becomes excessive, the carriage driving force becomes in excess of a desired degree and the spring must bend too excessively. As a result, the durability problem occurs. Therefore, at a time point as which the degree of overlapping of the gears is less, the slide gear 44 is made in mesh with ASF gear 33.

Next in step S5 the sheet feed motor 20 is energized to drive five steps so that the slide gear 44 is in mesh with the ASF 16 output gear 33. Furthermore, in step S6, pressure of the slide gear 44 against the ASF output gear 33 is released so that the slide gear 44 is movable to a predetermined position. More specifically, the slide gear 44 is made into partial engagement with the ASF output gear 33 at a position 2 mm before the position at which the slide gear 44 is completely made in mesh with the ASF output gear 33.

Thereafter, under the condition that the slide gear 44 is released from the ASF output gear 33, in step S7 the carriage is displaced to the position which is about 2 mm before the position at which the slide gear 44 is completely in mesh with the ASF output gear 44.

As described above, owing to the combinations of the routines each for moving the carriage between the two adjacent positions, the carriage can be moved between any two positions.

(Example of Skip Operation)

Figure 12:
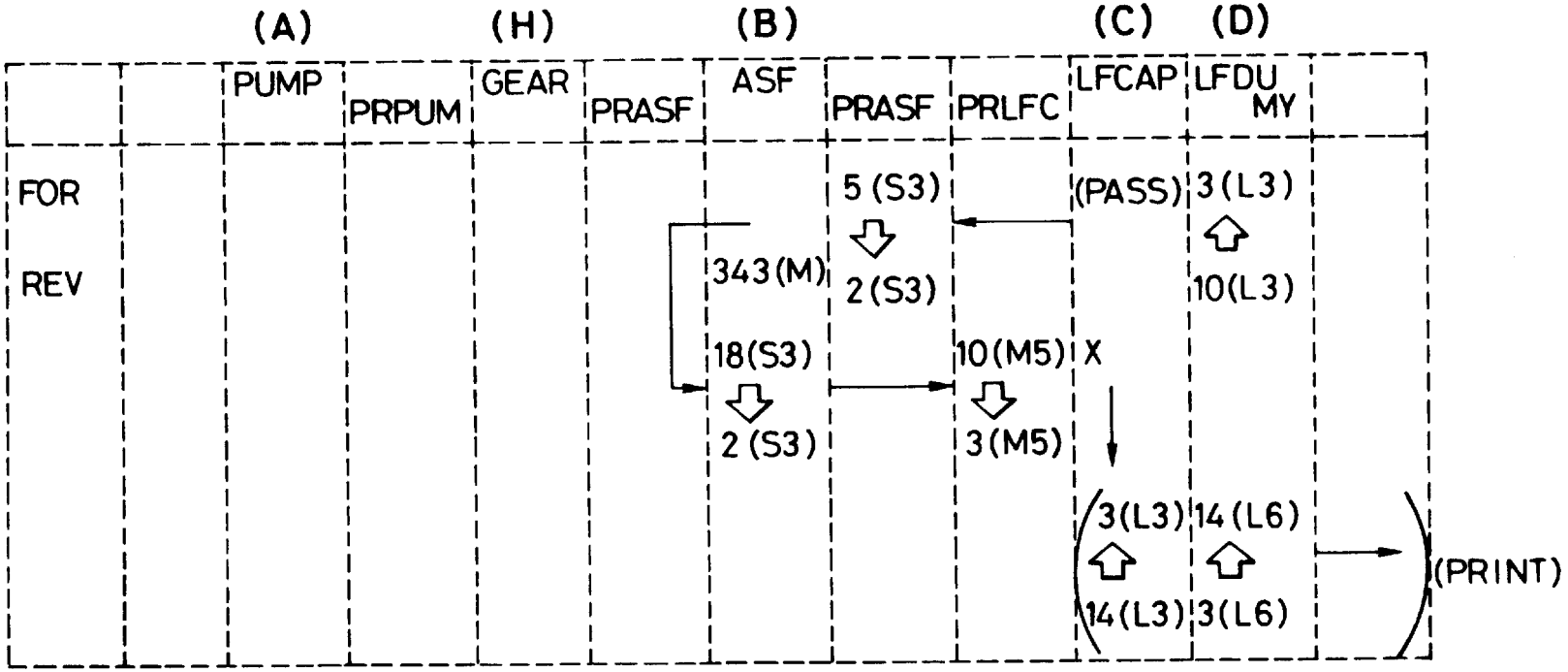
FIGS. 12 and 13 are views each used to explain the loading of a recording sheet by ASF energized in response to a bypass decision.
Figure 13:
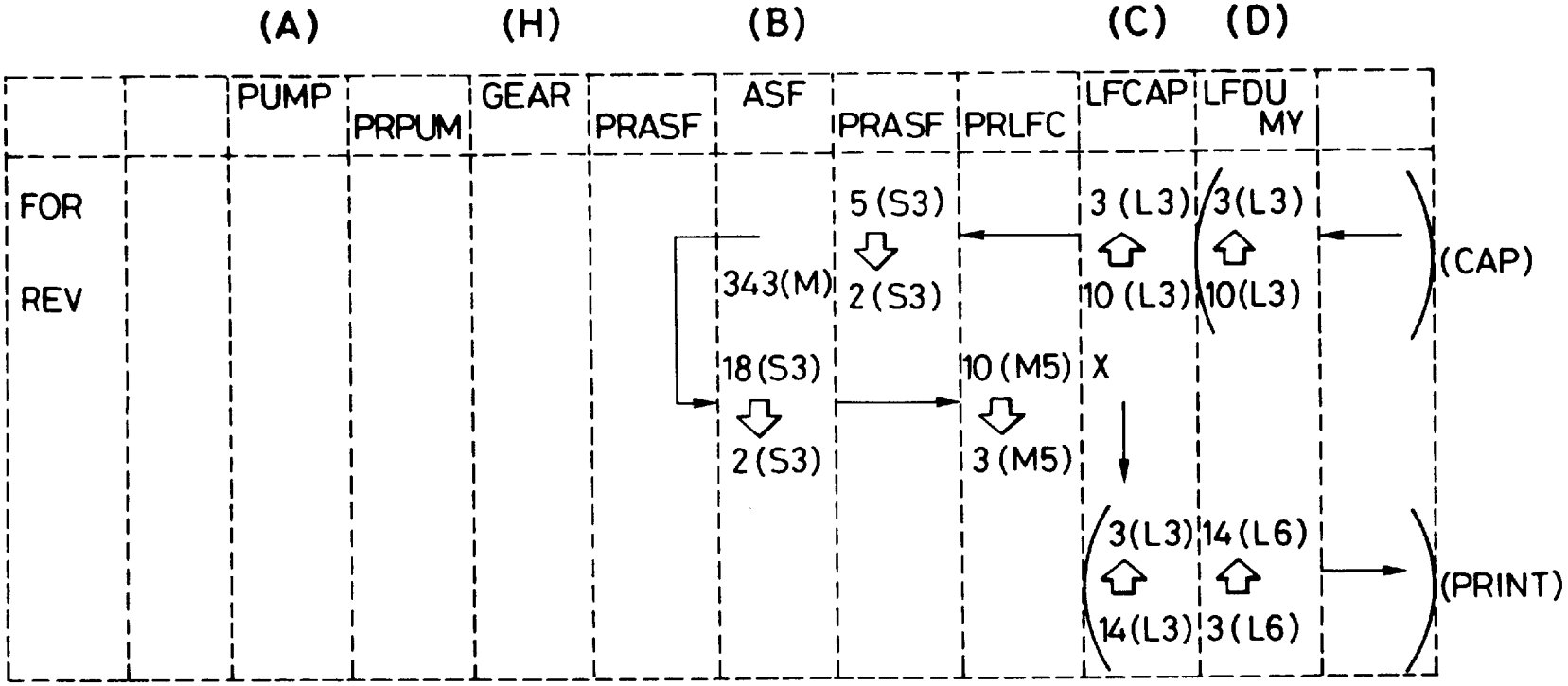

Next referring to FIGS. 12 and 13, how the skip decision made in step Si in FIG. 10 is actually used will be described. FIG. 12 illustrates the operation of the feed motor as a drive source for feeding a recording sheet into the recording apparatus and the displacement of the carriage when the cap is opened. FIG. 13 illustrates the operation of the motor 20 for feeding a recording sheet into the recording apparatus by ASF 16 and the displacement of the carriage 2 when the recording head 1 is capped.

The positions (A)–(D) and (H) are positions at which the carriage 2 is stopped for accomplishing the above-described switching operations. The position indicated by "PRXXX" is the position spaced apart by about 2 mm in the right or left direction of each operation position shown in step S4 in FIG. 10. For instance, "PRASF" represents the position located before the "ASF" position. It follows therefore that (A) PUMP-(D) LEDUMY correspond to the positions at which the carriage is sequentially stopped when the carriage is moved from the left. Furthermore, the small arrows indicate the movement of the carriage or the control flow while the large arrows indicate the order of the forward direction and the reverse direction of the rotation of the recording sheet feed motor. The number of steps in the forward direction of the recording sheet feed motor is indicated on the upper side of each large arrow and L (the large current), M (the medium current) or S (the small current) and the excitation phase switching time are indicated in the parenthesis. Similar notations are indicated on the lower side of the large arrow in the case of the rotation in the reverse direction. For instance, the first operation is indicated at the right upper corner in FIG. 12. That is, the recording sheet feed motor 20 is rotated by 10 steps in the reverse direction during the phase excitation time 3 ms with the large current and then is rotated in the forward direction by three steps during the phase excitation time 3 ms with the large current.

First referring to FIG. 13, no skip operation will be described. The operation is started when the carriage 2 is stopped at the cap position (C) at which the recording head is capped. Under these conditions, there exists the possibility that the operation such as the recording sheet feed operation has been carried out so that there is the possibility that the slide gear 44 is pressed against the recording sheet output gear 34. Therefore, it is required in steps S2 and S3 shown in FIG. 10 that the motor is rotated by 10 steps in the reverse direction and then by 3 steps in the forward direction, thereby releasing the pressure of the gear 44 against the gear 34. Thereafter, the carriage 2 is moved to the position PRASF which is spaced apart by 2 mm before the ASF operation position (B). Then, the motor is rotated by five steps in the forward direction so as to engage the slide gear 44 with the ASF output gear 34 and then rotated in the reverse direction by two steps, thereby releasing the pressure of the slide gear 44 against the gear 34. Thereafter, the carriage 2 is displaced to the ASF operation position (B) and then the sheet supply roller 18 in the ASF 16 are caused to rotate by 343 steps to accomplish the feed operation of a recording sheet 5. Next the motor 20 is rotated in the forward direction by 18 steps and then reversed in rotation by two steps so as to release the pressure of the slide gear 44 against the ASF output gear 34 and to displace the carriage 2 to the position spaced apart by about 2 mm before the capping position. Next the recording sheet feed motor 20 is rotated in the forward direction by 10 steps so that the slide gear 44 is made in mesh with the recording sheet feed output gear 34. Thereafter, the motor 20 is rotated in the reverse direction by 3 steps to release the pressure of the slide gear 44 against the gear 34 and then the carriage 2 is displaced to the capping position (C). When the motor 20 is rotated in the forward direction while the slide gear 44 is maintained in mesh with the sheet feed output gear 34, a recording sheet is loaded into the recording apparatus. In this case, the motor is rotated by a predetermined number of steps (X) from the position at which the leading edge of the recording sheet is detected.

Next the operation shown in FIG. 12 will be described. When the carriage is stopped at the preliminary discharge of ink position (D), the motor is rotated in the reverse direction by 10 steps and then forwarded in rotation by three steps so the slide gear 44 becomes free and therefore both the slide gears 44 and the carriage 2 become free to move. The carriage 2 is displaced to the capping position (C). In FIG. 13, thereafter even though the feed motor 20 is rotated in the reverse direction and then in the forward direction, these operations are skipped in FIG. 12. The reason is that at the preliminary discharge position (D) and at the capping position (C), the slide gear 44 is in mesh with the sheet feed output gear 34, and the pressure of the slide gear against the sheet feed output gear 34 has been released at the preliminary ink ejection (D) so that it is not necessary to release the pressure of the gear 44 against the gear 34 again at the capping position (C). The operations to be carried out thereafter are similar to those shown in FIG. 13.

(Operations When Power Source Is Turned On)

Figure 14:
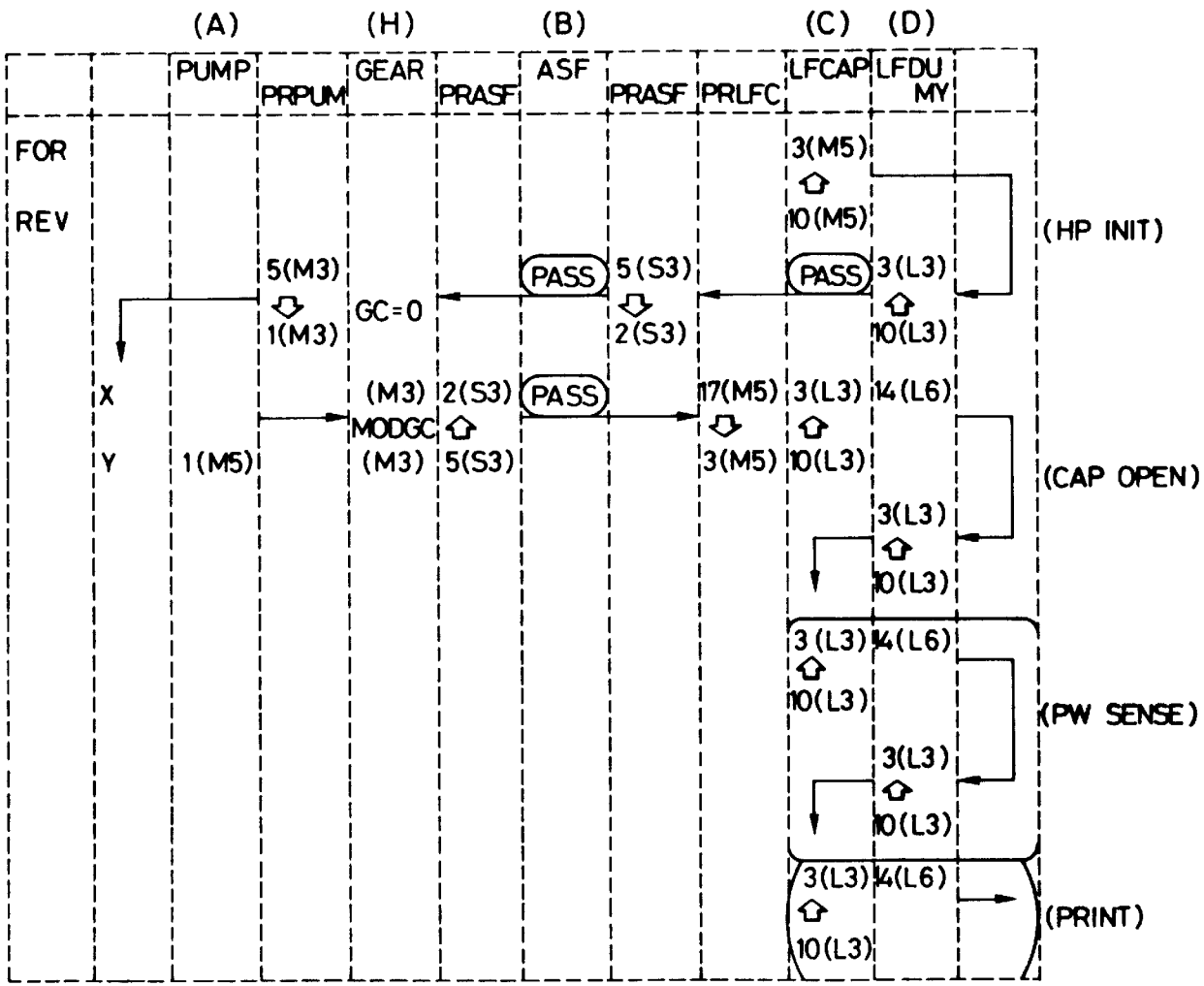
FIG. 14 is a view used to explain the initial operation when a power source is turned on in the printing mode in which a continuous recording sheet or web is loaded.

FIG. 14 illustrates the operations to be carried out after the power source is turned on under the condition that a continuous recording sheet such as a fanfold paper has been inserted into the recording apparatus.

Under the condition that the carriage 2 is stopped at the capping position (C) so that the recording head is capped, the sheet feed motor 20 is rotated in the reverse direction by 10 steps and then forwarded in rotation by three steps, thereby releasing the pressure of the gear 44. Thereafter, the carriage 2 is moved in the right direction to detect the home position and then the initial operation of the carriage motor 100 is carried out. Thereafter, under the condition that the carriage 2 is stopped at the preliminary ink discharge position (D), the sheet feed motor 20 is rotated in the reverse direction by 10 steps and then forwarded in rotation by 3 steps, thereby releasing pressure of the gear 44. Thereafter, the carriage 2 is shifted to the capping position (C) at which the sheet feed motor 20 is not energized as described hereinbefore with reference to FIG. 12 so that the carriage 2 is shifted to the position before the ASF position.

At this position, the sheet feed motor 20 is rotated in the forward direction by 5 steps so that the slide gear 44 is made in mesh with the ASF output gear 33 and then the motor 20 is reversed in rotation by two steps, thereby releasing the pressure of the gear 44. next the carriage 2 is shifted to the ASF position (B). Under this condition, the pressure between the slide gear 44 and the ASF output gear 33 is released so that the gear pressure release operation is not required. Therefore, the carriage 2 is shifted past through the gear-adjustment position (H) to the position before the recovery operation position (A). During this operation, a gear counter (which may use a predetermined space in a RAM) for counting the number of steps of the sheet feed motor 20 is reset to "0". When the carriage 2 is stopped at the position before the recovery position, the sheet feed motor 20 is rotated in the forward direction by 5 steps to engage the gear 44 with the pump output gear 32. In this case, the gear counter counts five steps so that it displays "5". When the motor 20 is reversed in rotation by one step, the pressure of the gear 44 is released while the gear counter is decremented by one and therefore indicates "4".

After the carriage 2 has been shifted to the recovery position (A), the sheet feed motor 20 is rotated by X steps in the forward direction and then reversed in rotation by Y steps, and the recovery operation is carried out by driving the pump 27. In this case the gear counter is incremented everytime when the sheet feed motor 20 is rotated in the forward direction and is decremented everytime when the motor 20 is reversed in rotation. After the recovery operation has been accomplished the sheet feed motor 20 is further rotated by one step in the reverse direction, thereby releasing the pressure of the gear 44 against gear 32. In this case, the gear counter is decremented by one step. Thereafter, the carriage 2 is moved to the gear adjustment position (H) which is located between the recovery operation position (A) and the ASF position (B) and at which the slide gear 44 does not engage not only with the pump output gear 32 but also with the ASF output gear 33. In this case, the motor 20 is rotated in the direction opposite to the direction of the plus or minus sign of the remainder resulting from the division of the value of the counter by a number of steps (for instance, 6 steps) of one tooth of the slide gear 44. For instance, when the value indicated by the gear counter is "+26", or "−26", the remainder of the division 26÷6=4 becomes "2" so that the motor is rotated by two steps in the reverse or forward direction. Due to such operation, the phase of the teeth of the slide gear 44 when the carriage 2 is moved from the gear adjustment position (H) to the recovery position (A) coincides with the phase of the teeth of the slide gear 44 when the carriage 2 is returned from the recovery position to the position (H).

After the carriage 2 has been displaced to the position before a predetermined distance from the ASF position (B), the sheet feed motor 20 is reversed in rotation by steps to engage the slide gear 44 with the ASF output gear 33 and then the motor 20 is rotated in the forward direction by two steps, thereby releasing the pressure of the gear 44 against the gear 33. Thereafter the carriage 2 is displaced to the ASF position (B) and then to the position before the capping position by a predetermined distance. When the motor 20 is rotated by 17 steps in the forward direction, the slide gear 44 is made in mesh with the recording sheet gear 34.

As described above, at the gear adjustment position (H) the phase of the teeth of the slide gear 44 in the case of the displacement of the carriage 2 to the left direction coincides with the tooth phase of the gear 44 in the case of movement of the carriage 2 in the right direction. Furthermore, when the carriage 2 is moved in the left direction so that the slide gear 44 is disengaged from the sheet feed output gear 34 and then moved to the gear adjustment position (H), the motor 20 is driven by 5 steps in the forward direction and then reversed in rotation by 2 steps. As a result, the motor is rotated by three steps in the forward direction. When the carriage 2 is moved in the right direction so that the gear 44 is moved from the gear adjustment position to the position before the sheet feed output gear 34, the motor 20 is driven by 5 steps in the reverse direction and then forwarded by 2 steps, so that the motor 20 is rotated by 3 steps in the reverse direction. Therefore, when the phase of the slide gear 44 is made coincident as described above, the phase with which the sheet feed output gear 34 is disengaged from the slide gear 44 simultaneous with the displacement to the left direction of the carriage 2 can automatically coincide with the phase at which the sheet feed output gear 34 engages with the slide gear 44 simultaneous with the movement of the carriage 2 in the left direction. Therefore when the carriage 2 is shifted to the right to the position before the capping position by a predetermined distance, the slide gear 44 is smoothly in mesh with the sheet feed output gear 34 without striking against it. All the force for driving the motor 20 by 17 steps in the forward direction so as to engage the gear 44 with the gear 34 is used to rotate the sheet feed output gear 34 by 17 steps.

The forward and reverse rotations of the recording sheet output gear 34 from the first operation until the printing operation (PRINT) including the detection of width of the recording sheet (PW SENSE) are summarized as follows: (10 steps in the reverse direction and 3 steps in the forward direction), (10 steps in the reverse direction and 3 steps in the forward direction), (17 steps in the forward direction the 3 steps in the reverse direction), (10 steps in the reverse direction and 3 steps in the forward direction), (14 steps in the forward direction), (10 steps in the reverse direction and 3 steps in the forward direction), (10 steps in the reverse direction and 3 steps in the forward direction), (14 steps in the forward direction) and (10 steps in the reverse direction and 3 steps in the forward direction).

As a result, when the initial operation is started and accomplished, a continuous recording sheet which is set at a predetermined position remains unchanged from its recording position.

For instance, when the operation of meshing the gears is not carried out, in the case of the forward rotation by 17 steps described above, there is a possibility that the slide gear 44 is not in mesh with the recording sheet feed output gear 34 (the state in which the tooth or teeth of the former strike against the tooth or teeth of the latter) so that the driving force for rotating a first few steps of 17 steps cannot rotate the sheet feed output gear 34. As a consequence, the angle of rotation of the sheet feed output gear 34 in the forward direction becomes small and therefore after the initial operation, the recording sheet is moved backwardly and downwardly. Thus the above-described operation is very effective.

(Recovery Operation)

Figure 15:
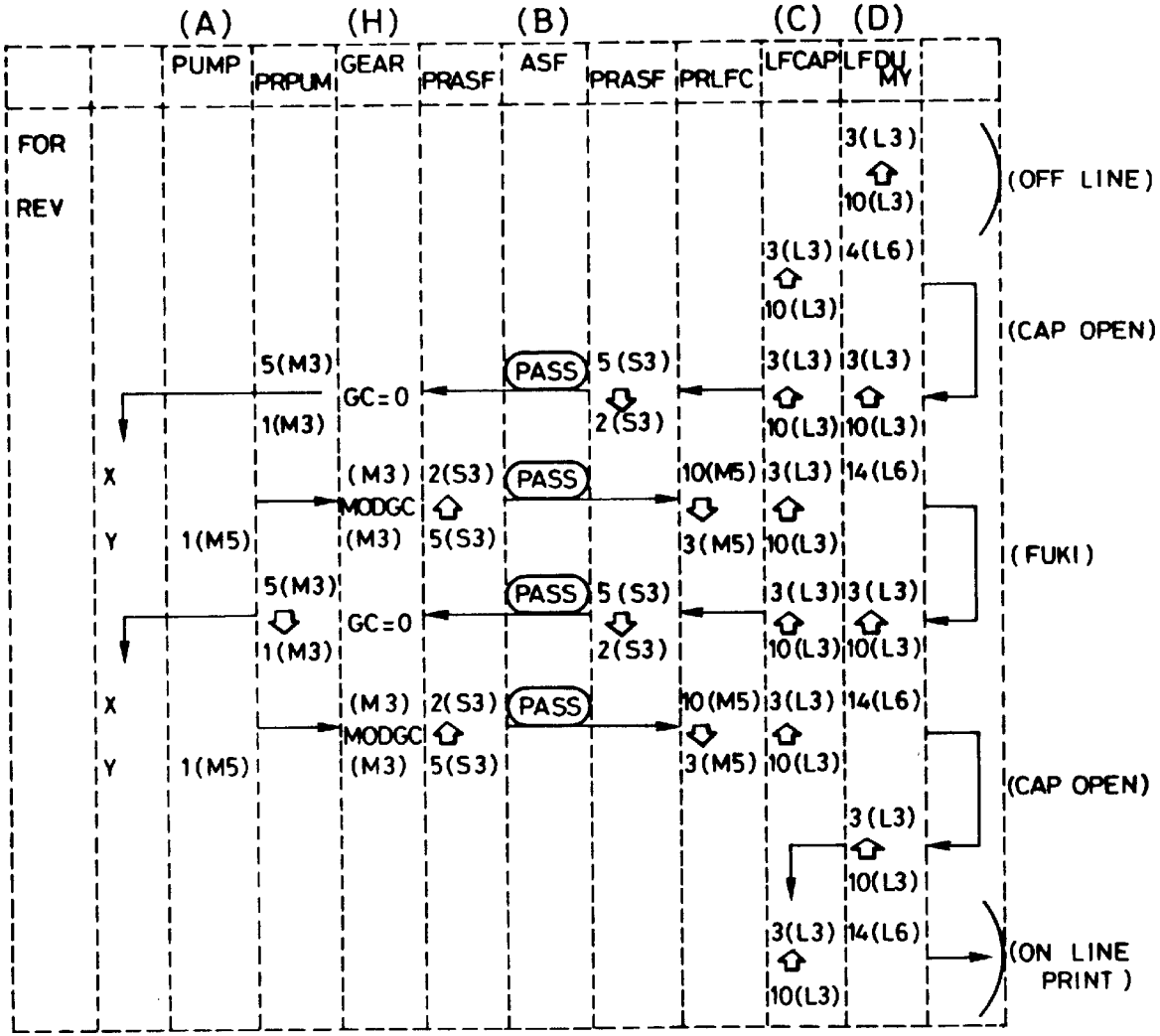
FIG. 15 is a view used to explain the recovery operation.

FIG. 15 illustrates the recovery operation, in which the actions similar to those described above with reference FIG. 14 are carried out. The carriage 2 is displaced once to the left to the recovery position and then is returned in the right direction to the position on the right side of the preliminary ink discharge position (D) so that the operation of wiping the face of the discharging portion of the recording head 1 (FUKI) is effected. Thereafter the carriage 23 is returned again to the recovery position (A) to carry out the remaining operations.

In this recovery operation, similar to the above, when the carriage 2 is shifted to the right to the position before the capping position (C), the slide gear 44 is in mesh with the sheet feed output gear 34, so that all the forces supplied by the feed motor 20 are used to rotate the sheet feed output gear.

As a result, all the operations of the sheet-feed motor carried out in the right direction from the position (PRLFC) before the capping operation by a predetermined distance are for feeding a recording sheet into the recording apparatus so that the steps in the clockwise direction and in the counterclockwise direction are cancelled and therefore the feed becomes "0". Prior to and after the recovery operation, the off-line (OFF LINE) and on-line (ON LINE) operations with an image data supply source are carried out.

(Initial Operation)

Next referring to FIGS. 16A and 16B–19, the initial operation of the recording apparatus will be described, but the operation similar to the above-described switching operation shall not be repeated in this specification.

Figure 16A:
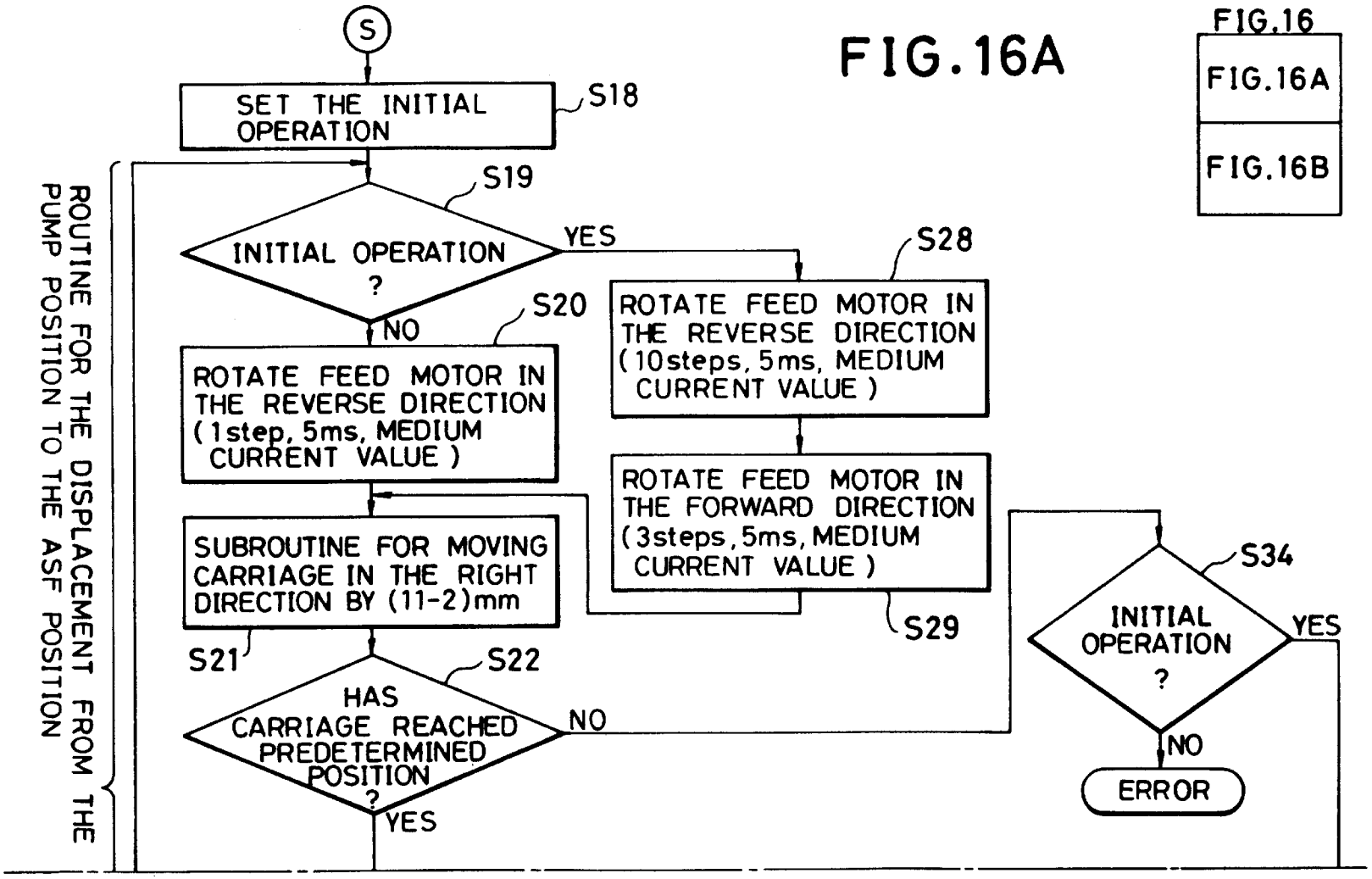
FIGS. 16A, 16B and 17 show a flowchart used to explain the initial operation procedure.
Figure 16B:
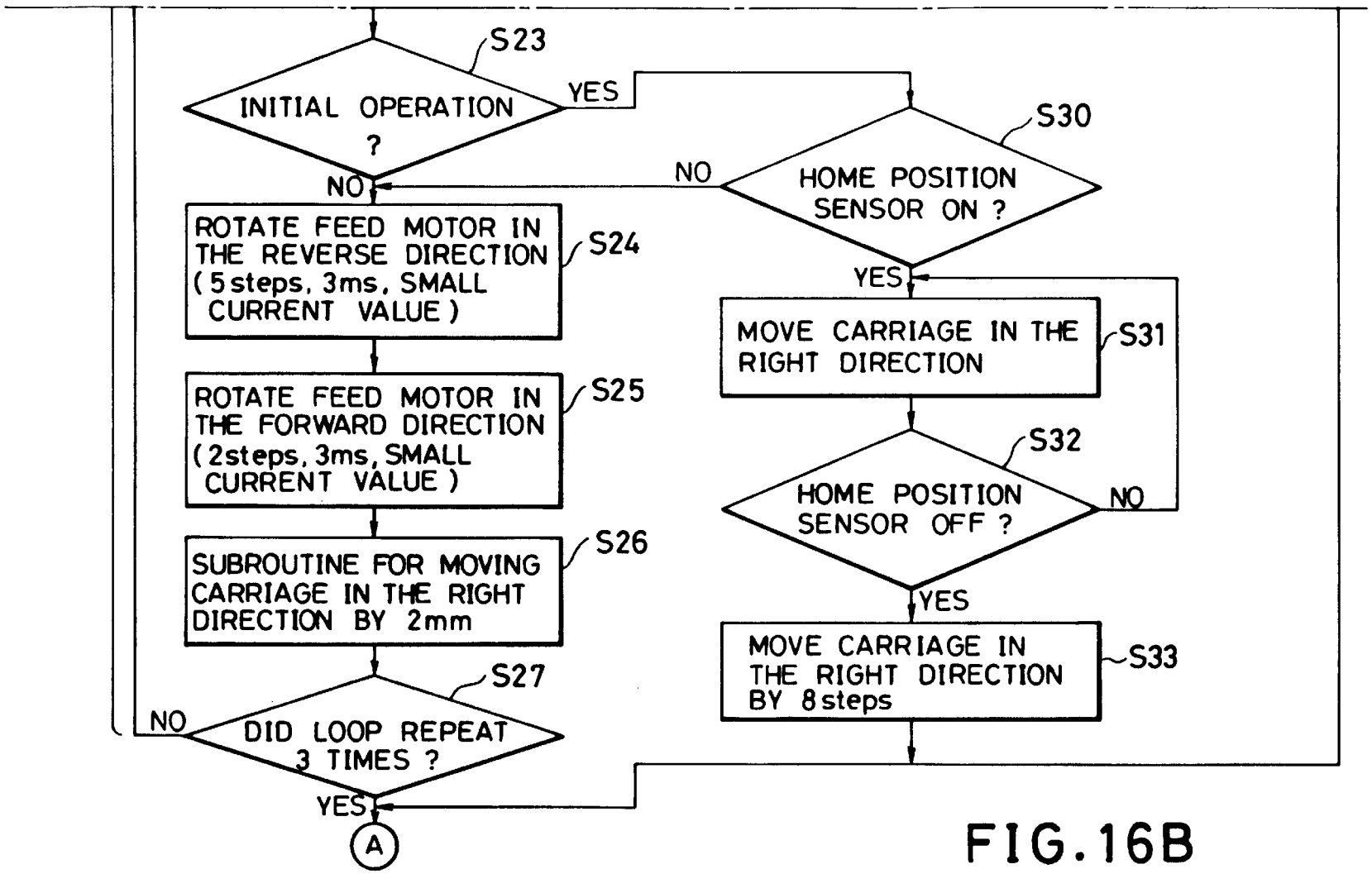
Figure 17:
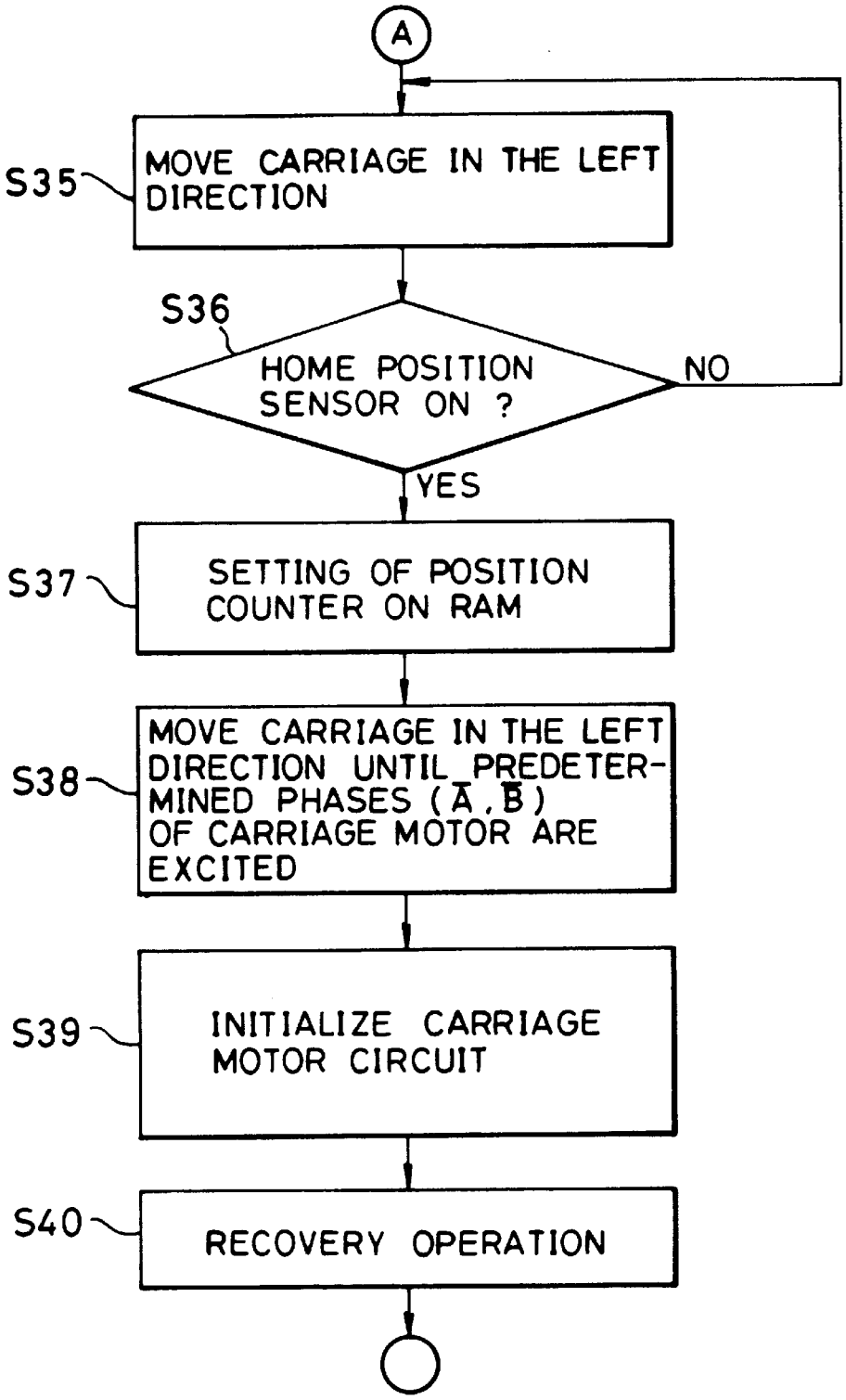

FIGS. 16A, 16B and 17 illustrate one example of the initial operation steps. First, at the step S18, the operation to be carried out hereinafter is defined as the initial operation. The reason is that since the subroutine from steps S19 to S26 is also used as the subroutine for the displacement from the pump position to the ASF position, the decision whether or not the subroutine is for the initial operation must be made.

When step S19 decides that the initial operation shall not be made or in the case of the displacement from the pump position to the ASF position, prior to the steps to be carried out hereinafter, only the recording sheet feed motor 20 is reversed in rotation by one step at step S20, but in the case of the initial operation the motor is rotated by 10 steps into the reverse direction and then forwarded in rotation by 3 steps in steps S28 and S29, thereby releasing the pressure imparted to the gears. By this gear pressure releasing operation, the pressure of the slide gear 44 is released at any of the pump position, the ASF position the capping operation and so on.

Next in step 21, the carriage 2 is moved by 9 mm in the right direction. This is the position indicated by <1> in the right direction with respect to each carriage position (•) in the initial operation from "Case 1"–"Case 5" in FIG. 19. For instance, when the carriage 2 is at the "PUMP" position as shown in "Case 3", the position is before the ASF position by 2 mm. It should be noted here that in this routine, the recovery sequence described above with reference to FIG. 11 is carried out.

Next in step S22, whether or not the carriage 2 has reached a predetermined position is detected. When the carriage 2 fails to reach a predetermined position even when the above-described recovery sequence is carried out, in this initial operation, it is detected that the carriage 2 is at the vicinity of the right end or a position similar to "Case 5" and therefore the carriage 2 cannot be displaced any more so that the procedure proceeds through step S34 to step S35. On the other hand, when the carriage 2 has reached the predetermined position, the sensor 29 for detecting whether or not the carriage 2 is stopped at its home position in the case of the initial operation is turned or of off (step S30). When the home position sensor 29 is in the OFF state, the carriage 2 is detected in the state of "Case 2", "Case 3" or "Case 4". Therefore, after the gears are engaged and then the pressure is released in step S24 and S25, and at step S26, the carriage 2 is shifted by 2 mm. The position at which the carriage 2 is brought in the manner described above is the position <2> in the "Case 2–4". In response to the result made in step S27, a loop of sequential steps is detected not to be repeated three times, the sequence is returned to step S19.

Figure 19:
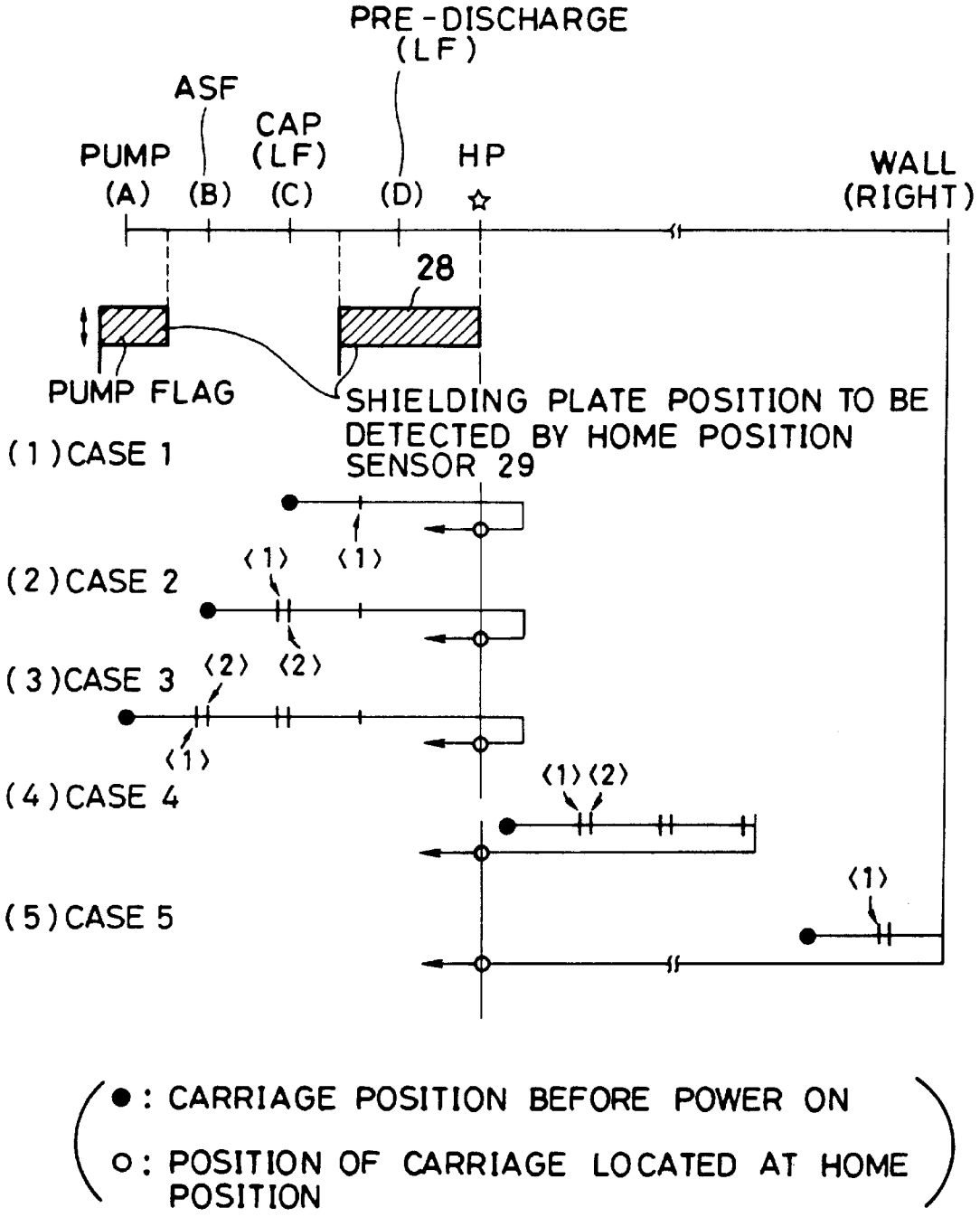

As shown in FIG. 19, extended in the direction of the displacement of the carriage 2 is the stationary shutter or shielding plate 28 which interrupts the light beam emitted from, for instance, a transparent type home position sensor 29 mounted on the carriage 2, and detects whether or not the carriage 2 is at its home position (HP). According to this embodiment, the shutter 28 is also disposed in such way that the sensor 29 is turned on when the carriage 2 is in the vicinity of the preliminary ink discharge position (D). As described above, the home position sensor 29 is turned on in step S30 only in the "Case 1" and in this case, the carriage 2 is shifted in the right direction in steps S31 and S32 until the home position sensor 29 is once turned off and further the motor 100 is rotated by a predetermined number of steps (in step S33, 8 steps) so that the carriage 2 is shifted further in the right direction in order to leave some margin.

"Case 2" indicates that the sensor is turned on in step S30 when the loop is carried out twice; "Case 3" shows that the sensor is first turned on in step S30 when the loop is carried out three times; and "Case 4" represents that the sensor is not turned on even when the loop has been repeated three times. When the sensor is not turned on even when the loop has been repeated three times, as in the "Case 4", the carriage 2 is detected as being shifted at the right side of the shielding plate or stationary shutter of the home position sensor 29. In this connection, "Case 5" means that the carriage 2 has failed to reach the predetermined position in step S22 during the second repetition of the loop.

Figure 18:
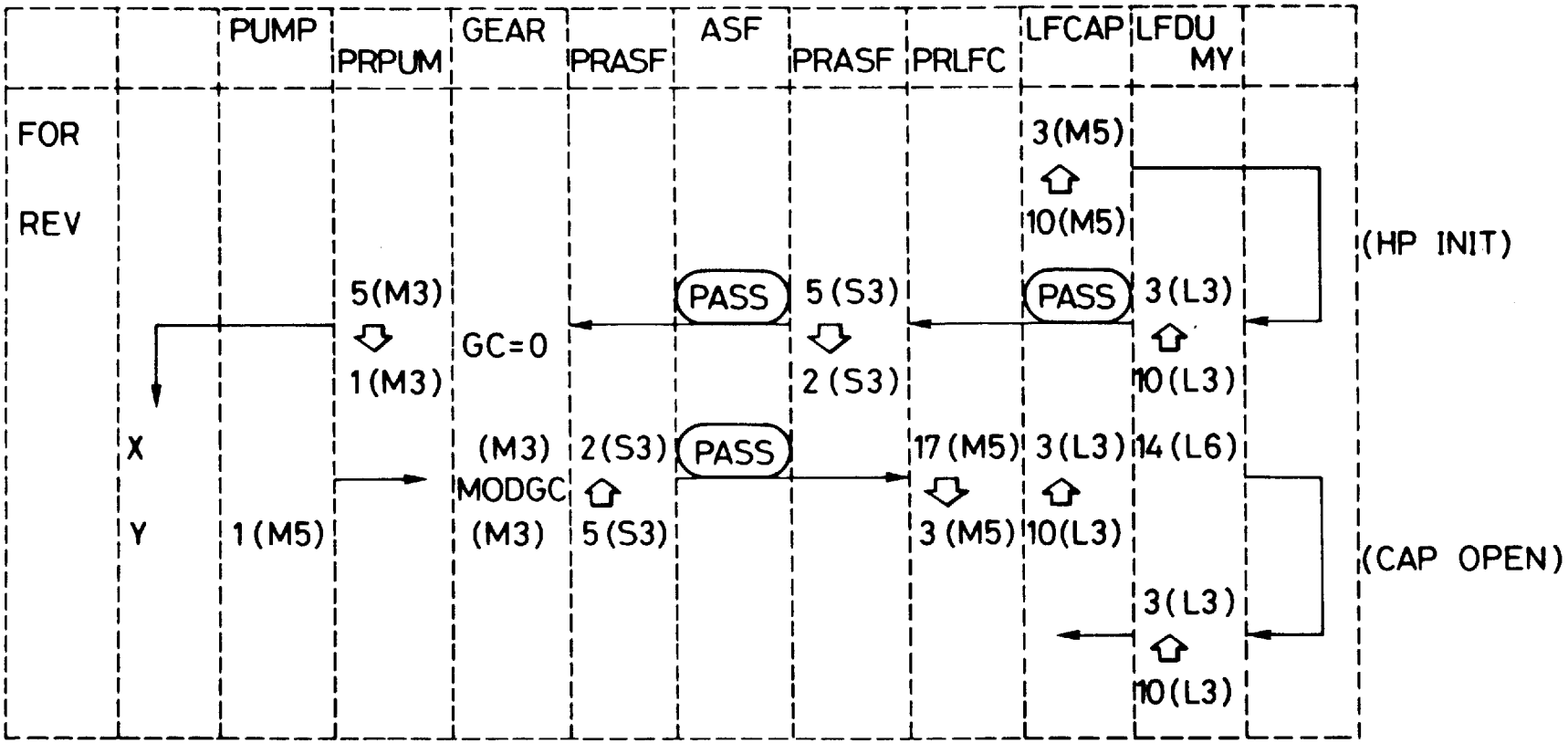
FIG. 18 is a view used to explain the mode of operation of the recording sheet feed motor in the initial operation.

As described above, after the carriage 2 has been detected to have moved on the right side of the shielding plate 28 of the home position sensor 29, while the carriage 2 is being shifted in the left direction in steps S35–S37, the setting of the position counter is made when the carriage 2 passes past the position HP. After the carriage 2 has been shifted by a few steps in steps S38 and S39 the initial operation of the carriage motor circuit is carried out. Thereafter, as shown in FIG. 18, while the above-described gear switching operations is being carried out, the recovery operation is started, whereby the initial operation is accomplished.

When the power source is turned off, the carriage 2 is normally located at the capping position (that is, the position of "Case 1") and in this case, the above-described loop is carried out only once, so that the operation time is shortened. Furthermore, as shown in "Cases 1–5" described above, regardless of the fact the carriage 2 is located at any position even though the initial operation has not yet been accomplished and prior to the setting of the position counter on the RAM of the recording apparatus, the initial operation is carried out without causing any problems such as interruption of the displacement of the carriage due to the fact that the pressure imparted to the gears is not released.

(Other Embodiments)

In the case of the example described above with reference to FIG. 14, the motor is rotated by the number of steps corresponding to the remainder of the division in the direction opposite to the sign of the remainder, but the process for rotating the motor in the same direction by a number of steps which is short of a multiple of the number of steps corresponding to the pitch of the teeth of the slide gear may be accomplished.

In FIG. 14, the division by the number of the steps corresponding to the pitch of the slide gear 44 is carried out. However, when the initial operation has been accomplished after the power source is turned on, the last excitation phase of the sheet feed motor is not always the same one. For example, in the case of a four-phase motor, when the initial operation is started at the first phase and, for instance, when the power source is turned off at the second phase, the gear is rotated in excess of a predetermined number of steps in the forward or reverse direction when the power source is turned on again. Therefore, when the division by the common multiple 12 between the steps 6 corresponding to the pitch of the gear and the number of the phases 4 of the motor, it becomes possible to coincide the phase of the motor excitation when the gear 44 is made into mesh with the sheet-feed output gear 34. As a result, the first phase of the motor is exited when the power source is turned on and when the initial operation is accomplished, the motor is deenergized at the excitation of the fourth phase. Therefore, when the power source is turned off, the first phase is excited according to the phase excitation sequence when the power source is turned on again so that the gear is rotated by a predetermined angle without excessive or insufficient rotation. As a result, after the power source is turned on to start the initial operation, regardless of the number of turning-off operations of the power source, the sheet feed output gear 34 remains at the same position so that when a recording sheet has been inserted into the recording apparatus, the position of the sheet remains unchanged.

The same result can be attained when the motor is rotated by 2 steps, for instance, in the reverse direction in accordance with the rotation calculated in the case of the gear engagement described above with reference to FIG. 14, thereby shifting the gear in the forward direction and in order to engage the slide gear with the sheet feed output gear 34 at the position before the capping position by a predetermined distance, the motor is rotated in the forward direction by 17+2=19 steps instead of 17 steps in the forward direction. in this case, 2 steps are used to engage the gear 44 with the gear 34 and thereafter the rotating force is transmitted to the sheet feed output gear 34, whereby the same result can be attained. However, in this case, when the number of steps in the reverse direction is in excess of 5 steps, the gear-engagement is made at the position before the desired gear-engagement position so that the maximum number of steps in the reverse direction must be 5.

So far the present invention has been described in conjunction with the example of the closed-loop or feedback driving and the switching of the driving of the step motor in response to the value of the counter which is disposed on MPU and indicates a predetermined position of the carriage 2, especially the example of driving the step motor at the wiping position, especially further the example of driving the step motor at the gear switching mechanism position and the example of the phase switching timing of the step motor 100 and the PWM value at the predetermined carriage 2 position on MPU.

However, for example, as a method for counting the position of the carriage 2 instead of using the counter for counting the encoder output signals, it is possible to control the position of the carriage 2 in response to the phase switching timing itself of the motor 100. Furthermore, so far the step motor has been described as being controlled by switching the PWM value, but it is possible to employ other suitable driving methods such as the driving method by controlling the current. In addition, so far the step motor driving and the closed-loop driving are used for the motor 100 for driving the recording head scanning carriage 2, but they may be also used for a sheet feed motor which is required to attain a high degree of resolution or whose driving noise must be suppressed as much as possible.

It has been described also that the adjustment of the driving torque is carried out by changing the PWM value every time when the phase switching is carried out, but it is possible to switch the electric power value by the conventional current control and by the switching of the value of the voltage in the case of the driving at a constant voltage.

In addition, regarding the phase excitation method, not only the 1–2 phase excitation method described above, but also any other suitable method may be employed. For instance, the 3–4 phase excitation system, the 2–3 phase excitation system or the like may be used.

Furthermore, the following recovery control methods have been described. In the first method, the carriage driving force is increased; in the second method, the carriage shift speed is decreased; in the third method, the rotational speeds of the gears are slowed down; and in the fourth method, the gears are rotated in the forward and reverse directions. But the completely same operation may be repeated.

Moreover, in order to detect whether or not the sliding gear is located at a predetermined position, in the above-described embodiment, the position sensor which responds to the encoder output signals during the time when the carriage motor 100 is driven by a predetermined maximum number of steps is used, but it is to be understood that any other suitable detection method may be employed.

As described above, according to the present invention, control sequences each for causing the slide gear to shift from one gear engagement position to the adjacent gear engagement position are so combined that the slide gear is shifted past the adjacent gear engagement position to a desired gear engagement position, and the overlapped step or steps are skipped. Thus, a switching speed of a driving power source can be made fast while maintaining high reliability.

According to the present invention, the member to be detected for detecting reference position of the recording head or its mounting members (the carriage) is also used for detecting a position of the gear shift mechanism at the initialization etc. Therefore, an operation of the mechanism which is to be done before setting the carriage at the reference position is decided at an initialization time, a shift operation at the initialization time can be shortened and suitable initialization operations in any case can be performed.

Moreover, in a gear shift operation, the present invention provides an apparatus, which can achieve a stable and highly reliable operation, a high-speed operation, and a low-noise operation by lowering power used for a usual operation, regardless of load variations of the gears or the carriage, or action of external force.

Moreover, according to the present invention, the slide gear (a second transmission member) engageable with the carriage makes both phases described below coincide with each other. That is, the phase, when the slide gear is disengaged from the gear, for feeding a recording sheet which is one of a plurality of gears (first transmission members) to determine each operation, and the phase, when the slide gear is engaged with the above gear again are coincided with each other. For example, the number of steps of a driving motor, which have been accumulated during the time from the disengagement till the re-engagement, is controlled so that it accords with a multiple of the number of steps of one tooth pitch of the slide gear. The number of the accumulated steps is counted in such a way that it has a plus sign in a forward direction and a minus sign in a reverse direction of the motor rotation. Additionally, the number of the accumulated steps of the motor is controlled so that it also accords with a multiple of the number of steps corresponding to one cycle of the motor. The above control operation can prevent a deviation of pitches of the slide gear engaged with the carriage and the gear for feeding the recording sheet, when the slide gear is disengaged from the gear for feeding a recording sheet and then is engaged with the gear for feeding the recording sheet again. The above control operation can also prevent a deviation of a set recording sheet, which may be caused under the influence of disengagement or engagement of the gears during initialization when the power supply is turned on. That is, a position of the set recording sheet remains the same through turning on and off the power supply causes engagement and disengagement between the slide gear and the gear for feeding the recording sheet.

(Further Description)

In the case that the present invention is applied to an ink jet printer, the present invention is particularly suitably useable in an ink jet recording head having heating elements that produce thermal energy as energy used for ink ejection or discharge and recording apparatus using the head. This is because the high density of the picture element and the high resolution of the recording are possible.

The typical structure and the operational principle are preferably the ones disclosed in U.S. Pat. Nos. 4,723,129 and 4,740,796. The principle is applicable to a so-called on-demand type recording system and a continuous type recording system. Particularly, however, it is suitable for the on-demand type because the principle is such that at least one driving signal is applied to an electrothermal transducer disposed on liquid (ink) retaining sheet or ink passage, the driving signal being enough to provide such a quick temperature rise beyond a departure from nucleation boiling point, but which the thermal energy is provide by the electrothermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Patent Laid-Open Application No. 138461/1984 wherein an opening for absorbing pressure waves of the thermal energy is formed corresponding to the ejecting portion. This is because the present invention is effective to perform the recording operation with certainty and at high efficiency irrespective of the type of the recording head.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressure or suction means, preliminary heating means by the ejection electrothermal transducer or by a combination of the ejection electrothermal transducer and additional heating element and means for preliminary ejection not for the recording operation, which can stabilize the recording operation.

As regards the kinds and the number of the recording heads mounted, a single head corresponding to a single color ink may be equipped, or a plurality of heads corresponding respectively to a plurality of ink materials having different recording colors or densities may be equipped. The present invention is effectively applicable to an apparatus having at least one of a monochromatic mode solely with a main color such as black and a multi-color mode with different color ink materials or a full-color mode by color mixture. The multi-color or full-color mode may be realized by a single recording head unit having a plurality of heads formed integrally or by a combination of a plurality of recording heads.

Furthermore, in the foregoing embodiment, the ink has been liquid. It may, however, be an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material is solidified when it is left unused to prevent the evaporation of the ink. In either of the cases, the application of the recording signal producing thermal energy, the ink may be liquified, and the liquified ink may be ejected. The ink may start to be solidified at that time when it reaches the recording material. The present invention is applicable to such an ink material as is liquified by the application of the thermal energy. Such an ink material may be retained as a liquid or solid material on through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output means of various types of information processing apparatuses such as a work station, personal or host computer, a word processor, a copying apparatus combined with an image reader, a facsimile machine having functions for transmitting and receiving information, or an optical disc apparatus for recording and/or reproducing information into and/or from an optical disc. These apparatuses require means for outputting processed information in the form of a hard copy.

Figure 20:
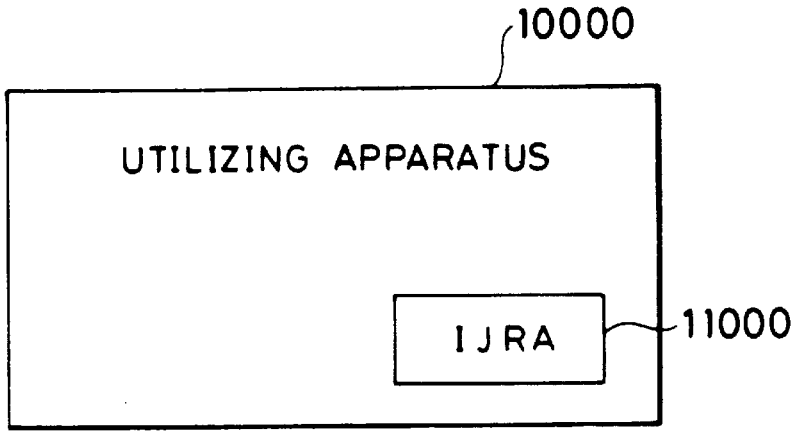
FIG. 20 is a schematic diagram illustrating one embodiment of an utilizing apparatus in accordance with the present invention.

FIG. 20 schematically illustrates one embodiment of a utilizing apparatus in accordance with the present invention to which the ink jet recording system shown in FIG. 1 is equipped as an output means for outputting processed information.

In FIG. 20, reference numeral 10000 schematically denotes a utilizing apparatus which can be a work station, a personal or host computer, a word processor, a copying machine, a facsimile machine or an optical disc apparatus. Reference numeral 11000 denotes the ink jet recording apparatus (IJRA) shown in FIG. 1. The ink jet recording apparatus (IJRA) 11000 receives processed information from the utilizing apparatus 10000 and provides a print output as a hard copy under the control of the utilizing apparatus 10000.

Figure 21:
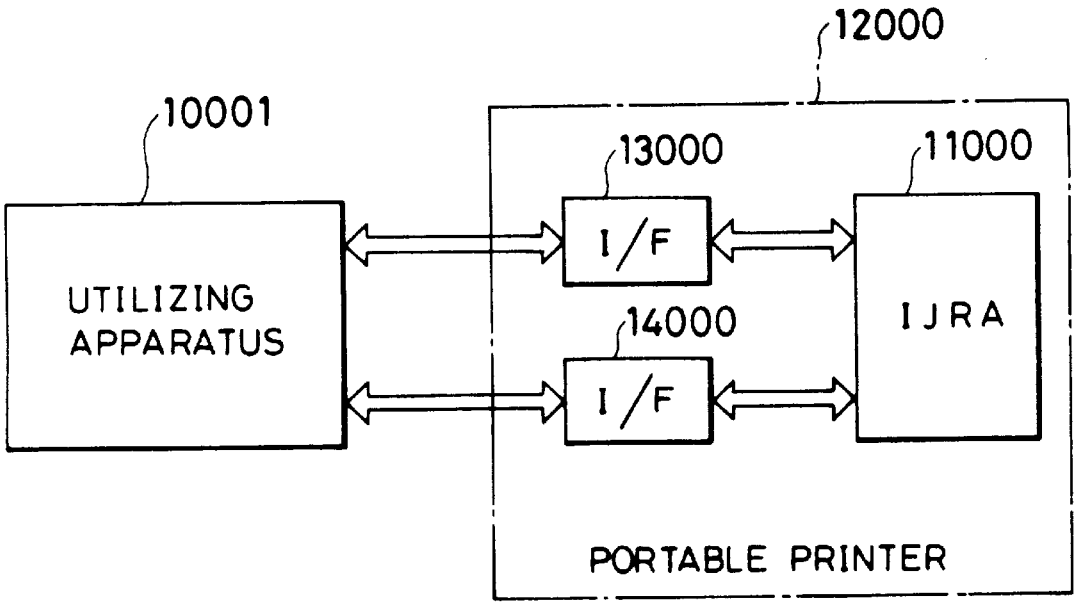
FIG. 21 is a schematic diagram illustrating another embodiment of a utilizing apparatus in accordance with the present invention.

FIG. 21 schematically illustrates another embodiment of a portable printer in accordance with the present invention to which a utilizing apparatus such as a work station, a personal or host computer, a word processor, a copying machine, a facsimile machine or an optical disc apparatus can be coupled.

In FIG. 21, reference numeral 10001 schematically denotes such a utilizing apparatus. Reference numeral 12000 schematically denotes a portable printer having the ink jet recording apparatus (IJRA) 11000 shown in FIG. 1 incorporated thereinto and interface circuits 13000 and 14000 receiving information processed by the utilizing apparatus 10001 and various controlling data for controlling the ink jet recording apparatus 11000, including hand shake and interruption control from the utilizing apparatus 10001. Such control per se is realized by conventional printer control technology.

The invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A recording apparatus comprising:

a carriage for reciprocally moving a recording head along a recording medium;

a driving power source for generating a first driving force;

a plurality of first transmission means for being driven by the first driving force generated by said driving power source;

second transmission means for engaging said driving power source and for releasably engaging one of said plurality of first transmission means, said second transmission means being moved by and corresponding to a position of said carriage and transmitting the first driving force from said driving power source to said plurality of first transmitting means;

first control means for controlling switching of said second transmission means between two adjacent transmission means among said plurality of first transmission means in accordance with one of a plurality of predetermined sequences, each sequence having a plurality of operations, at least two of said operations overlapping in result;

second control means for controlling switching of said second transmission means between two transmission means among said plurality of first transmission means which are not adjacent to each other in accordance with a combination of the plurality of predetermined sequences, of which an overlapped operation or operations are skipped;

means for detecting whether said second transmission means has reached or not a predetermined position in a switching operation of said second transmission means from engaging one of said first transmission means to engaging another of said first transmission means;

means for causing repetition of said switching operation when said second transmission means is not located at said predetermined position;

a step motor for outputting a second driving force and reciprocally moving said carriage along a recording medium with the second driving force, said step motor being drivable in accordance with switching of an exciting phase;

a first sensor detecting an angular position of said step motor;

a second sensor detecting a position of said carriage in response to an output signal from said first sensor;

means for driving said step motor by switching of the exciting phase according to predetermined exciting timings;

carriage control means for controlling the movement of said carriage with the second driving force of said step motor driven by said driving means and a position of said carriage detected by said second sensor;

third control means for controlling said second transmission means to be released from engagement with one of said plurality of first transmission means and then to return to engagement with said one of said plurality of first transmission means;

means for adjusting an engaging condition of said second transmission means upon said second transmission means being released from engagement with said one of said plurality of first transmission means and then returning to engagement with said one of said plurality of first transmission means, so that said second transmission means is engaged with said one of said plurality of first transmission means in a same engaging condition as that before said second transmission means is released from said one of said plurality of first transmission means;

a third sensor moving with said carriage; and a member to be detected by said third sensor, said member being disposed in a reciprocating path of said carriage and having an output used for a plurality of decisions.

2. A recording apparatus as claimed in claim 1, wherein said recording head member comprises an ink-jet recording head which discharges ink from a discharging portion thereof.

3. A recording apparatus as claimed in claim 1, wherein said recording head member comprises an ink-let recording head which has electro-thermal converting elements and discharges ink from a discharging portion by using thermal energy produced by said electro-thermal converting elements.

4. A recording apparatus comprising:

a carriage for reciprocally moving a recording head member along a recording medium;

a driving source for generating a driving force;

a plurality of first transmission means for being driven by the driving force generated by said driving power source;

second transmission means for engaging said driving power source and one of said plurality of first transmission means, said second transmission means being moved by and corresponding to a position of said carriage and transmitting the driving force from said driving power source to said plurality of first transmitting means;

means for controlling switching of said second transmission means between two adjacent transmission means among said plurality of first transmission means in accordance with one of a plurality of predetermined sequences, each sequence having a plurality of operations, at least two of said operations overlapping in result; and means for controlling said switching controlling means between first and second modes of switching of said second transmission means between two transmission means among said plurality of first transmission means which are not adjacent to each other in accordance with a combination of the plurality of predetermined sequences, wherein in the first mode an overlapped operation or operations are skipped and in the second mode the overlapped operation or operations are not skipped.

5. A recording apparatus as claimed in claim 4, wherein said overlapped operation or operations are procedures for releasing engagements of said second transmission means with one or more of said first transmission means situated between said two first transmission means which are not adjacent each other.

6. A recording apparatus as claimed in claim 4, wherein said head member comprises an ink-jet recording head which discharges ink from a discharging portion thereof.

7. A recording apparatus as claimed in claim 6, wherein said plurality of first transmission means comprises a first driving force transmission gear for feeding said recording medium in a recording operation, a second driving force transmission gear for supplying said recording medium into said recording apparatus and a third driving force transmission gear for driving a recovery device in order to ensure satisfactory discharge of said ink from said recording head;

said first, second and third driving force transmission gears being arranged in parallel with a direction in which said recording head is shifted in a space outside of a space in which said recording head records data on said recording medium; and said second transmission means comprises a gear positioned to engage with said carriage which is slidable in said recording space.

8. A recording apparatus as claimed in claim 4, wherein said head member comprises an ink-jet recording head which has electro-thermal converting elements and discharges ink from a discharging portion by using thermal energy produced by said electro-thermal converting elements.

9. A recording apparatus comprising:

a carriage for reciprocally moving a recording head along a recording medium;

a driving power source for generating a driving force;

a plurality of first transmission means for being driven by the driving force generated by said driving power source;

second transmission means for engaging said driving power source and for releasably engaging one of said plurality of first transmission means, said second transmission means being moved by and corresponding to a position of said carriage and transmitting the driving force from said driving power source to said plurality of first transmitting means;

movement control means for controlling said second transmission means to be released from engagement with one of said plurality of first transmission means and then to return to engagement with said one of said plurality of first transmission means; and means for adjusting an engaging condition of said second transmission means upon said second transmission means being released from engagement with said one of said plurality of first transmission means and then returning to engagement with said one of said plurality of first transmission means, so that said second transmission means is engaged with said one of said plurality of first transmission means in a same engaging condition as that before said second transmission means is released from said one of said plurality of first transmission means, wherein said driving power source comprises a step motor and said first and second transmission means comprise gears and said adjusting means includes adjustment control means for adjusting a number of advanced steps of said step motor from said release to said return to coincide with an even multiple of a number of steps corresponding to one tooth of said gear.

10. A recording apparatus as claimed in claim 9, wherein the number of advanced steps is determined as a common multiple of the number of steps corresponding to one tooth of said gear and a number of phases of one rotation of said motor.

11. A recording apparatus as claimed in claim 9, wherein said recording head member comprises an ink-let recording head which has electro-thermal converting elements and discharges ink from a discharging portion by using thermal energy produced by said electro-thermal converting elements.

12. A recording apparatus as claimed in claim 9, wherein said recording head member comprises an ink-jet recording head which discharges ink from a discharging portion thereof.

13. A recording apparatus as claimed in claim 12, wherein said plurality of first transmission means comprises a first driving force transmission gear for feeding said recording medium in a recording operation, a second driving force transmission gear for supplying said recording medium into said recording apparatus and a third driving force transmission gear for driving a recovery device in order to ensure satisfactory discharge of said ink from said recording head;

said first, second and third driving force transmission gears being arranged in parallel with a direction in which said recording head is shifted in a space outside of a space in which said recording head records data on said recording medium; and said second transmission means comprises a gear positioned to engage with said carriage which is slidable in said recording space.

14. A recording apparatus for performing recording on a recording medium with a recording head, said apparatus including a plurality of recording operation means for participating in performing recording operations, said apparatus comprising:

a driving power source generating a driving force that drives the plurality of recording operation means;

a plurality of first transmission means for being driven by the driving force generated by said driving power source;

second transmission means for engaging said driving power source and one of said plurality of first transmission means;

means for effecting operations comprising a plurality of predetermined sequences for switching of said second transmission means between two adjacent transmission means among said plurality of first transmission means, at least two of said operations overlapping in result; and means for effecting a skipping of an overlapped operation or operations in switching, by said operations effecting means, of said second transmission means between two transmission means among said plurality of first transmission means which are not adjacent to each other.

15. A recording apparatus as claimed in claim 14, wherein said recording head comprises an ink-jet recording head which has electro-thermal converting elements and discharges ink from a discharging portion by using thermal energy produced by said electro-thermal converting elements.

16. A recording apparatus as claimed in claim 14, wherein said overlapped operation or operations are procedures for releasing engagement of said second transmission means with one or more of said first transmission means situated between said two first transmission means which are not adjacent each other.

17. A recording apparatus as claimed in claim 14, wherein said recording head comprises an ink-jet recording head which discharges ink from a discharging portion thereof.

18. A recording apparatus as claimed in claim 17, wherein said plurality of first transmission means comprises a first driving force transmission gear for feeding said recording medium in a recording operation, a second driving force transmission gear for supplying said recording medium into said recording apparatus and a third driving force transmission gear for driving a recovery device in order to ensure satisfactory discharge of said ink from said recording head;

said first, second and third driving force transmission gears being arranged in parallel with a direction in which said recording head is shifted in a space outside of a space in which said recording head records data on said recording medium; and said second transmission means comprises a gear positioned to engage with said carriage which is slidable in said recording space.

19. A recording apparatus for performing recording on a recording medium with a recording head, said apparatus including a plurality of recording operation means for participating in performing recording operations, said apparatus comprising:

a first gear being movably supported along an axial direction;

a power source for generating a driving force that drives the plurality of recording operation means, and that drives said first gear;

second gears being engagable with said first gear;

first control means for controlling engagement and disengagement between said first gear and one of said second gears, wherein in engagement said first gear and the one of said second gears are mutually pressed and in disengagement pressure is released and said first gear and the one of said second gears are separated from each other away from an engagable position; and second control means for judging whether said first gear and the one of said second gears are mutually pressed or pressure is released upon said first gear and the one of said second gears being separated from each other away from the engagable position, wherein said second control means, upon said first gear and the one of said second gears being mutually pressed, controls said power source to drive said first gear for releasing pressure between said first gear and the one of said second gears, and upon the pressure between said first gear and the one of said second gears being released, said second control means controls said power source not to drive said first gear for releasing the pressure between said first gear and the one of said second gears at the next recording operation.

20. A recording apparatus as claimed in claim 19, wherein said recording head comprises an ink-jet recording head which has electro-thermal converting elements and discharges ink from a discharging portion by using thermal energy produced by said electro-thermal converting elements.

21. A recording apparatus as claimed in claim 19, wherein said recording head comprises an ink-jet recording head which discharges ink from a discharging portion thereof.

22. A recording apparatus as claimed in claim 21, wherein said second gears comprise a first driving force transmission gear for feeding a recording medium in a recording operation, a second driving force transmission gear for supplying the recording medium into said recording apparatus and a third driving force transmission gear for driving a recovery device in order to ensure satisfactory discharge of said ink from said recording head;

said first, second and third driving force transmission gears being arranged in parallel with a direction in which said recording head is shifted in a space outside of a space in which said recording head records data on the recording medium; and said first gear comprises a gear positioned to engage with a carriage which is slidable in the recording space.

23. A recording apparatus for performing recording on a recording medium with a recording head, said apparatus including a plurality of recording operation means for participating in performing recording operations, said apparatus comprising:

a first gear being movably supported along an axial direction;

a power source for generating a driving force that drives the plurality of recording operation means, and that drives said first gear;

second gears being engagable with said first gear;

first control means for effecting operations comprising a plurality of predetermined sequences for switching of said first gear between two adjacent gears among said second gears, at least two of said operations overlapping in result;

means for effecting a skipping of an overlapped operation or operations in switching, by said first control means, of said first gear between two gears among said second gears which are not adjacent to each other, wherein said overlapped operation or operations are procedures for releasing engagement of said first gear with one or more of said second gears situated between said two second gears which are not adjacent each other;

second control means for controlling engagement and disengagement between said first gear and one of said second gears, wherein in engagement said first gear and the one of said second gears are mutually pressed and in disengagement pressure is released and said first gear and the one of said second gears are separated from each other away from an engagable position; and third control means for judging whether said first gear and the one of said second gears are mutually pressed or pressure is released upon said first gear and the one of said second gears being separated from each other away from the engagable position, wherein said third control means, upon said first gear and the one of said second gears being mutually pressed, controls said power source to drive said first gear for releasing pressure between said first gear and the one of said second gears, and upon the pressure between said first gear and the one of said second gears being released, said third control means controls said power source not to drive said first gear for releasing the pressure between said first gear and the one of said second gears.

24. A recording apparatus as claimed in claim 23, wherein said recording head comprises an ink-jet recording head which discharges ink from a discharging portion thereof.

25. A recording apparatus as claimed in claim 23, wherein said second gears comprise a first driving force transmission gear for feeding a recording medium in a recording operation, a second driving force transmission gear for supplying the recording medium into said recording apparatus and a third driving force transmission gear for driving a recovery device in order to ensure satisfactory discharge of said ink from said recording head;

said first, second and third driving force transmission gears being arranged in parallel with a direction in which said recording head is shifted in a space outside of a space in which said recording head records data on the recording medium; and said first gear comprises a gear positioned to engage with a carriage which is slidable in the recording space.

26. A recording apparatus as claimed in claim 23, wherein said recording head comprises an ink-jet recording head which has electro-thermal converting elements and discharges ink from a discharging portion by using thermal energy produced by said electro-thermal converting elements.

* * * * *

UNITED STATES PATENT AND TRADEMARK OFFICE

CERTIFICATE OF CORRECTION

PATENT NO. : 6,015,202

DATED : January 18, 2000

INVENTOR(S) : HIRAMATSU, ET AL.

It is certified that error appears in the above-identified patent and that said Letters Patent is hereby corrected as shown below:

[56] References:

U.S. PATENT DOCUMENTS, insert --4,947,331 8/1990 Speranza . . . . . 364/424.084--.

FOREIGN PATENT DOCUMENTS, "1082962" should read --1-82962--, "1202462" should read --1-202462--, "2208073" should read --2-208073--, and "35181" should read --3-5181--.

IN THE DRAWINGS:

Sheet 10, Figure 10, "MOVE" should read --MOVING--.

COLUMN 1:

Line 16, "use as" should read --use a--.

Line 18, "referred" should read --referred to--.

Line 43, "corresponding" should read --corresponding to--.

COLUMN 2:

Line 4, "invention to" should read --invention is to--.

Line 22, "operation" should read --operation,--.

Line 24, "operation" should read --operation;--, and "that is" should read --that is,--.

Line 36, "P" should be deleted and "In a" should begin a new paragraph.

COLUMN 4

Line 13, "reached" should read --has reached--.

Line 22, "them" should read --them on--.

UNITED STATES PATENT AND TRADEMARK OFFICE

CERTIFICATE OF CORRECTION

PATENT NO. : 6,015,202

DATED : January 18, 2000

INVENTOR(S) : HIRAMATSU, ET AL.

It is certified that error appears in the above-identified patent and that said Letters Patent is hereby corrected as shown below:

COLUMN 6:
Line 8, "has" should read --having--.
Line 51, "plurality" should read --a plurality--.

COLUMN 7:
Line 7, "show" should read --shown--.
Line 41, "an utilizing" should read --a utilizing--.

COLUMN 8:
Line 23, "hands" should read --hand--.
Line 53, "hands" should read --hand--.

COLUMN 9:
Line 48, "31. An" should read --31, an--.

COLUMN 10:
Line 1, "slider" should read --slide--.
Line 11, "slide" should read --slide gear--.
Line 13, "slide" should read --slide gear--.

COLUMN 11:
Line 15, "Fig. 69," should read --Fig. 6B,--.

COLUMN 12:
Line 23, "101A" should read --100A--.
Line 48, "10A." should read --100A.--.

UNITED STATES PATENT AND TRADEMARK OFFICE

CERTIFICATE OF CORRECTION

PATENT NO. : 6,015,202

DATED : January 18, 2000

INVENTOR(S) : HIRAMATSU, ET AL.

It is certified that error appears in the above-identified patent and that said Letters Patent is hereby corrected as shown below:

COLUMN 13:
Line 64, "two phases" should read --two phase--.
Line 66, "two phases" should read --two phase--.

COLUMN 14:
Line 3, "phases" should read --phase--.
Line 39, "the each" should read --each--.

COLUMN 15:
Line 52, "In" should begin a new paragraph.

COLUMN 16:
Line 3, "deter-" should read --are deter- --.
Line 4, "to 5" should read --(to 5--.
Line 19, "as" should read --at--.
Line 42, "Si" should read --S1--.
Line 67, "parenthesis." should read --parentheses.--.

COLUMN 17:
Line 27, "are" should read --is--.
Line 52, "gears" should read --gear--.

COLUMN 18:
Line 22, "next" should read --Next--.

UNITED STATES PATENT AND TRADEMARK OFFICE

CERTIFICATE OF CORRECTION

PATENT NO. : 6,015,202

DATED : January 18, 2000

INVENTOR(S) : HIRAMATSU, ET AL.

It is certified that error appears in the above-identified patent and that said Letters Patent is hereby corrected as shown below:

COLUMN 19:
Line 3, "by steps" should read --by 5 steps--.
Line 49, "direction the" should read --direction and--.

COLUMN 20:
Line 9, "reference" should read --reference to--.
Line 55, "position" (second occurrence) should read --position,--, and "operation" should read --position--.

COLUMN 21:
Line 10, "or of off" should read --on or off--.
Line 57, "tions" should read --tion--.

COLUMN 22:
Line 23, "division" should read --division is made--.
Line 29, "exited" should read --excited--.
Line 51, "in" should read --In--.

COLUMN 24:
Line 27, "through" should read --though--.
Line 49, "but" should read --by--, and "provide" should read --provided--.

COLUMN 25:
Line 56, "producing" should read --produces--.

UNITED STATES PATENT AND TRADEMARK OFFICE

CERTIFICATE OF CORRECTION

PATENT NO. : 6,015,202

DATED : January 18, 2000

INVENTOR(S) : HIRAMATSU, ET AL.

It is certified that error appears in the above-identified patent and that said Letters Patent is hereby corrected as shown below:

COLUMN 29:
Line 40, "ink-let" should read --ink-jet--.

Signed and Sealed this

Tenth Day of April, 2001

*Attest:*

Nicholas P. Godici

NICHOLAS P. GODICI

*Attesting Officer*

*Acting Director of the United States Patent and Trademark Office*